US009855637B2

(12) United States Patent
Whipple et al.

(10) Patent No.: US 9,855,637 B2
(45) Date of Patent: Jan. 2, 2018

(54) THERMOGRAPHIC CHARACTERIZATION FOR SURFACE FINISHING PROCESS DEVELOPMENT

(71) Applicant: Apple Inc., Cupertino, CA (US)

(72) Inventors: Lucas Allen Whipple, Belmont, CA (US); Simon Regis Louis Lancaster-Larocque, Gloucester (CA); Collin D. Chan, Dublin, CA (US); Christopher R. Fagan, Pacifica, CA (US); Vincent Yan, San Francisco, CA (US); Ian S. Theilacker, West Chester, PA (US); Brian K. Miehm, Los Altos, CA (US); Shravan Bharadwaj, San Jose, CA (US)

(73) Assignee: Apple Inc., Cupertino, CA (US)

( * ) Notice: Subject to any disclaimer, the term of this patent is extended or adjusted under 35 U.S.C. 154(b) by 43 days.

(21) Appl. No.: 14/638,892

(22) Filed: Mar. 4, 2015

(65) Prior Publication Data

US 2015/0290764 A1 Oct. 15, 2015

Related U.S. Application Data

(63) Continuation of application No. PCT/US2015/018588, filed on Mar. 4, 2015.
(Continued)

(51) Int. Cl.
*B24B 49/14* (2006.01)
*B24B 49/12* (2006.01)
(Continued)

(52) U.S. Cl.
CPC ..... *B24B 49/14* (2013.01); *B24B 49/006* (2013.01); *B24B 49/12* (2013.01); *B24B 49/16* (2013.01); *B24B 37/015* (2013.01)

(58) Field of Classification Search
CPC ..... B24B 37/015; B24B 49/006; B24B 49/12; B24B 49/14; B24B 49/16
See application file for complete search history.

(56) References Cited

U.S. PATENT DOCUMENTS 3,597,888 A * 8/1971 Kusakabe ..... B24B 49/14 451/11
4,438,598 A * 3/1984 Wohlmuth ..... B24B 49/14 374/131

(Continued)

FOREIGN PATENT DOCUMENTS

EP 2310173 11/2013

OTHER PUBLICATIONS

PCT Application No. PCT/US2015/018588—International Search Report and Written Opinion dated Jun. 23, 2015.

*Primary Examiner* — Timothy V Eley
(74) *Attorney, Agent, or Firm* — Downey Brand LLP

(57) ABSTRACT

A method and system for observing and monitoring thermal characteristics of a machining operation, such as a surface finishing operation, performed on a workpiece is disclosed. The surface finishing operation can be performed on the workpiece in order to remove a surface defect, e.g. a parting line, on a surface of the workpiece and/or to provide a mirror-like finish to the workpiece. In one embodiment, an emissive layer is applied to the workpiece to increase a thermal emissivity of the workpiece. In some embodiments, a finishing surface, such as a polishing or buffing wheel, and/or a lubricant used in a finishing operation is monitored. A thermal profile of the surface of the workpiece, finishing surface and/or lubricant can be obtained. The finishing operation can be modified in response to the monitored thermal characteristics to prevent the occurrence of defects and improve the efficacy of the finishing operation.

14 Claims, 20 Drawing Sheets

Related U.S. Application Data

(60) Provisional application No. 61/962,324, filed on Apr. 10, 2014.

(51) Int. Cl.

| | |
|---|---|
| ***B24B 49/16*** | (2006.01) |
| ***B24B 49/00*** | (2012.01) |
| *B24B 37/015* | (2012.01) |

(56) References Cited

U.S. PATENT DOCUMENTS

| | | | | |
|---|---|---|---|---|
| 5,722,875 | A | 3/1998 | Iwashita et al. | |
| 5,882,244 | A * | 3/1999 | Hiyama | B24B 49/14 451/285 |
| 5,899,792 | A | 5/1999 | Yagi | |
| 6,116,987 | A * | 9/2000 | Kubo | B24B 29/04 451/264 |
| 6,148,248 | A * | 11/2000 | Sun | B24B 5/307 451/11 |
| 6,328,636 | B1 * | 12/2001 | Yoshimi | B23Q 11/1053 451/443 |
| 6,562,185 | B2 * | 5/2003 | Avanzino | B24B 37/015 156/345.13 |
| 6,669,532 | B1 * | 12/2003 | Mukai | B23Q 11/10 451/449 |
| 6,942,544 | B2 * | 9/2005 | Beaucage | B24B 49/14 451/41 |
| 6,984,162 | B2 * | 1/2006 | Bright | B24B 37/30 451/288 |
| 7,029,369 | B2 * | 4/2006 | Mikhaylich | B24B 21/04 451/307 |
| 7,682,225 | B2 * | 3/2010 | Hongo | B24B 9/065 451/168 |
| 8,304,344 | B2 * | 11/2012 | Boggs | B24B 37/044 438/689 |
| 2002/0039874 | A1 * | 4/2002 | Hecker, Jr. | B24B 37/013 451/7 |
| 2003/0119427 | A1 * | 6/2003 | Misra | B24B 49/14 451/41 |
| 2004/0074599 | A1 * | 4/2004 | Kneer | B24B 21/04 156/345.1 |
| 2005/0118839 | A1 * | 6/2005 | Chen | B24B 37/015 438/795 |
| 2006/0063472 | A1 * | 3/2006 | Matsumoto | B24B 37/015 451/7 |
| 2006/0135374 | A1 | 6/2006 | Cooper et al. | |
| 2008/0146119 | A1 * | 6/2008 | Sasaki | B24B 49/16 451/5 |
| 2010/0151771 | A1 | 6/2010 | Nabeya | |
| 2010/0191365 | A1 * | 7/2010 | Yonezu | B23Q 17/22 700/174 |
| 2013/0210173 | A1 * | 8/2013 | Wu | B24B 37/013 438/10 |
| 2014/0364040 | A1 * | 12/2014 | Sone | B24B 37/015 451/7 |
| 2015/0239089 | A1 * | 8/2015 | Hirayama | B24B 53/017 451/59 |

* cited by examiner

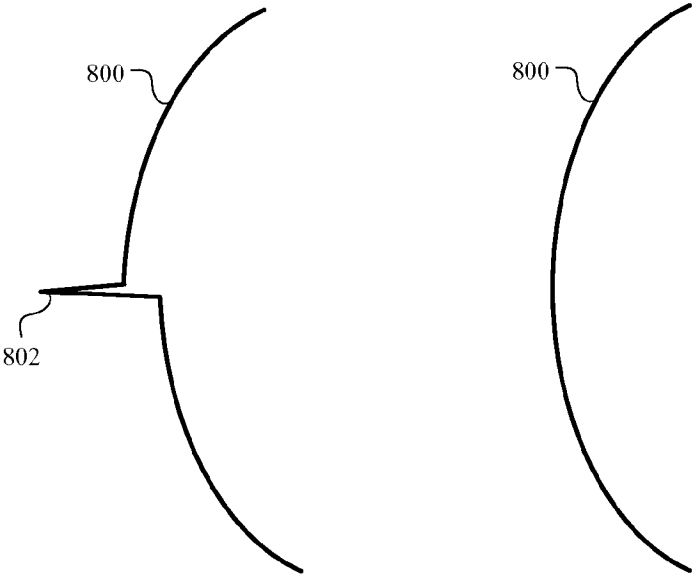
Before polish
FIG. 8A
Ideal
FIG. 8B
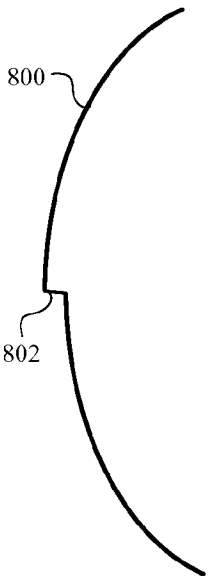
Under polished
FIG. 8C
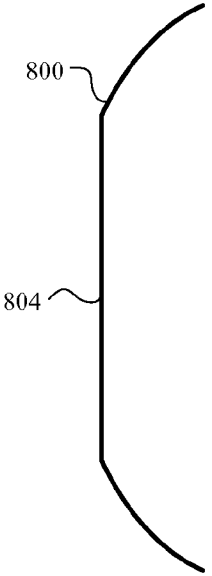
Over polished
FIG. 8D
Undesirable Results Non-ideal Non-ideal Ideal

THERMOGRAPHIC CHARACTERIZATION FOR SURFACE FINISHING PROCESS DEVELOPMENT

CROSS-REFERENCE TO RELATED APPLICATION

This is a continuation of PCT/US15/18588 filed Mar. 4, 2015, entitled "THERMOGRAPHIC CHARACTERIZATION FOR SURFACE FINISHING PROCESS DEVELOPMENT" and claims priority to U.S. Provisional Application Ser. No. 61/962,324 filed Apr. 10, 2014, entitled "THERMOGRAPHIC CHARACTERIZATION FOR SURFACE FINISHING PROCESS DEVELOPMENT", each of which is incorporated herein by reference in its entirety.

FIELD

The present disclosure relates generally to characterizing an operation that produces thermal radiation. More specifically, methods and apparatuses for using thermographic techniques to characterize an operation, such as a surfacing finishing operation or other machining operation performed on a workpiece, are disclosed.

BACKGROUND

Surface finishing operations, such as polishing or buffing, can produce unintended and undesired results. For example, over-polishing can cause pitting to form on a cosmetic surface of a part, thereby causing the over-polished surface to fall outside a desired specification (e.g., undesired aesthetic finish). In many cases, this type of defect can result in a total loss of the part. Determining a cause for the defect can often be difficult. One technique involves assigning an inspector to manually inspect a finished product (e.g., a polished workpiece) after the operation is complete. When a defect is detected, the inspector provides feedback to a machine operator. The machine operator can then make an educated guess as to why the defect occurred and adjust the operation accordingly. However, it is often difficult to ascertain where and why the defect occurred, particularly when the operation contains many steps.

Therefore, what is desired is an improved method for monitoring operations and characterizing causes for defects when performing surfacing operations on a workpiece.

SUMMARY

This paper describes various embodiments that relate to characterizing a machining operation on a workpiece, such as a finishing operation.

In one embodiment, a method for finishing a workpiece surface is described. The method includes performing a finishing operation by contacting an abrasive surface with the workpiece surface and moving the abrasive surface relative to the workpiece surface. A thermal characteristic of the workpiece changes during the finishing operation. The method also includes monitoring the changes of the thermal characteristic during the finishing operation. The method further includes adjusting the finishing operation based on the monitored changes of the thermal characteristic.

In another embodiment, a method of finishing a workpiece is described. The method includes applying an emissive layer to an outside surface of a workpiece. An emissivity of the emissive layer is substantially greater than an emissivity of the outside surface. The method also includes performing a finishing operation on the workpiece. A temperature of the emissive layer changes during the finishing operation. The method further includes monitoring an amount of thermal radiation emitted by the emissive layer during the surface finishing operation with a thermal imaging system. The thermal imaging system is configured to distinguish temperature variations of the emissive layer.

In yet another embodiment, a method of finishing a workpiece is described. The method includes performing a finishing operation by contacting a rotating finishing wheel with a contact patch area of the surface of the workpiece. A motor drives the rotating finishing wheel. The method also includes, during the finishing operation, monitoring an amount of electric current drawn by the motor, an amount of pressure applied to the workpiece, and a temperature of the workpiece. The method further includes, during the finishing operation, adjusting one or more process parameters until the amount of electric current reaches a target current, the amount of pressure reaches a target pressure, and the temperature reaches a target temperature.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings.

FIG. 8A shows a side view of a workpiece having a parting line.

FIGS. 8B-8D show potential outcomes when performing polishing operations on the workpiece of FIG. 8A.

DETAILED DESCRIPTION

Figure 1:
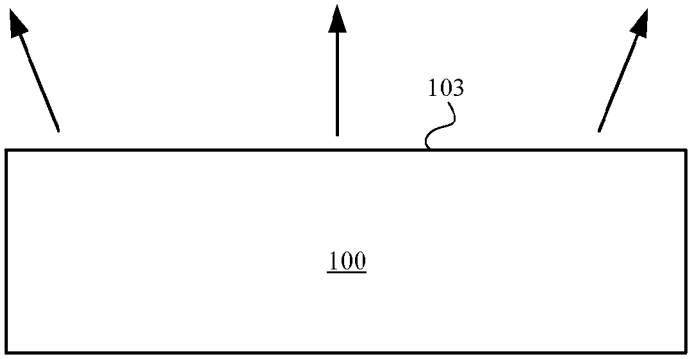
FIG. 1 shows a section view of a workpiece that can undergo a finishing operation.

Representative applications of methods and apparatuses according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

Techniques described herein relate to monitoring the performance of a machining operation by measuring thermal characteristics of a workpiece or other materials used during the machining operation. In some embodiments, thermal measurements of the workpiece, a finishing tool and/or a lubricant used in a finishing operation are measured in real time during the finishing operation. The thermal measurements can be used to monitor the progression of the finishing operation and adjust process controls resulting in an improved finished workpiece. In some embodiments, the thermal measurements are used to create a feedback system for automated surface finishing. In some cases, indirect measurements of the thermal characteristics, such as contact pressure and frictional measurements are to be monitored. In some embodiments, a combination of direct and/or indirect thermal measurements is monitored, providing a multiple variable feedback system.

According to some embodiments, an emissive layer is applied to a surface of the workpiece. The emissive layer has an emissivity that is greater than a surface of the workpiece that undergoes a finishing operation. Thermal data related to changes in temperature of the emissive layer can be monitored during a finishing operation, thereby providing a more reliable temperature monitoring compared to traditional thermal techniques. In some embodiments, thermal measurements are obtained from a different location of the workpiece than the surface that is being finished, such as a surface of the workpiece proximate to and opposing the surface being finished. In some embodiments, thermal measurements are obtained by monitoring a temperature of a device other than the workpiece itself, such as the finishing wheel (e.g., polishing or buffing wheel) and/or lubricant used in the finishing operation. In some embodiments, other process parameters that indicate a change in temperature of the workpiece are monitored, such as an electric current draw of the finishing wheel or contact pressure of the workpiece against the finishing wheel.

The monitored thermal data can be used to modify the finishing operation in real time. For example, a force between the workpiece and the finishing surface (e.g., wheel interference), amount of lubricant, relative rotational speed between the workpiece and finishing surface, and/or temperature of the workpiece/lubricant/finishing surface can be adjusted to increase or decrease the friction between the workpiece and the finishing surface, thereby increasing or decreasing the thermal characteristic of the finishing operation. In some embodiments, the multiple measurements are used to adjust multiple process parameters, creating a multiple variable feedback system.

Methods described herein are well suited for providing cosmetically appealing finished surfaces for consumer products. For example, the methods described herein can be used to form cosmetically appealing housings or enclosures for desktop computers and portable computers, mobile electronic devices and electronic device accessories, such as those manufactured by Apple Inc., based in Cupertino, Calif.

These and other embodiments are discussed below with reference to FIGS. 1-16. However, those skilled in the art will readily appreciate that the detailed description given herein with respect to these figures is for explanatory purposes only and should not be construed as limiting.

Surface finishing operations such as polishing and buffing involve removing material from a workpiece so as to create a smooth surface. Finishing operations generally involve contacting and moving an abrasive surface, such as a brush or material with embedded abrasive particles, against a contact surface of the workpiece. Often, the abrasive surface is attached to a rotating wheel or belt that is rotated at high speeds to provide efficient finishing. In some cases the finishing operation is designed to provide a mirror-like shine to a surface of the workpiece.

Friction can cause the build up of heat at the contact surface of the workpiece, which can detrimentally affect the finishing process. For example, some metal alloys (e.g., aluminum alloys) when heated to certain temperatures can force alloying elements out of the metal matrix (e.g., aluminum) and soften the metal alloy. When in this softer state, the metal alloys can be vulnerable to pitting during the polishing operation. In many cases, a lubricant, such as wax, is applied between the abrasive surface and workpiece to lessen the amount of friction at the contact surface. However, care must be taken to assure that lubricant maintains an adequate viscosity to reduce friction during the finishing operation. For example, if the workpiece and/or the abrasive surface are too cold, the viscosity of the lubricant can become too high to adequately lubricate the workpiece. In particular, if a wax lubricant is too cold, the wax can amalgamate and cause the finished surface to develop a hazy look instead of a nice mirrored, shiny appearance. If the wax becomes very cold, the wax can clump together in larger pieces, which can scratch or dent the surface of the workpiece. On the other hand, wax lubricant that is too hot can make the wax lose its lubricating properties. In particular, hot wax can lose its moisture content, causing the wax to lose its lubricating properties. Thus, careful management of the thermal characteristics of the workpiece, finishing surface and/or lubricant can be critical to achieving a reliable finishing operation.

One of the problems associated with monitoring the thermal characteristics of a workpiece during the finishing operation is that polished surfaces generally have a low emissivity. To illustrate, FIG. 1 shows a sectional view of workpiece 100 having a finished surface 103. Workpiece 100 can be made of any suitable material, such as metal, plastic, ceramic, glass, or a combination thereof. In some embodiments, workpiece 100 is made of a metal alloy, such as stainless steel or an aluminum alloy. In general, the emissivity of the surface of an object is its effectiveness in emitting energy as thermal radiation. The emissivity value (e) indicates how well an object emits radiation relative to a true black body (i.e., a perfect emitter) at the same temperature. A true black body has e=1, while a purely reflective body has e=0. Accordingly, recorded emissivity values range between 0 and 1. Generally, the duller and darker a material is, the closer its emissivity is to 1, while the more reflective (i.e., mirror-like) a material is, the closer its emissivity is to 0.

Accordingly, workpiece 100 emits thermal radiation, which is represented by arrows, in accordance with an emissivity corresponding to finished surface 103. If surface 103 is finished to a high shine, such as a mirror-like shine, workpiece 100 will have a low emissivity. Since the emissivity of workpiece 100 is low, it can be difficult to accurately determine a temperature profile for workpiece 100 with a thermal imaging device. This is because thermal imaging devices detecting reflected thermal radiation of an object with low emissivity will be represented by cool or dark colors in a thermal-infrared image, even if the true temperature of the object is high. For example, a mirror-polished aluminum workpiece will appear to be darker than a black chrome aluminum workpiece in a thermal image, even when the mirror-polished aluminum workpiece is hotter than the black chrome aluminum workpiece. Thus, use of thermal imaging device to detect thermal radiation of workpiece 100 during a finishing operation can often lead to inaccurate accounts of the true temperature of workpiece 100.

Figure 2A:
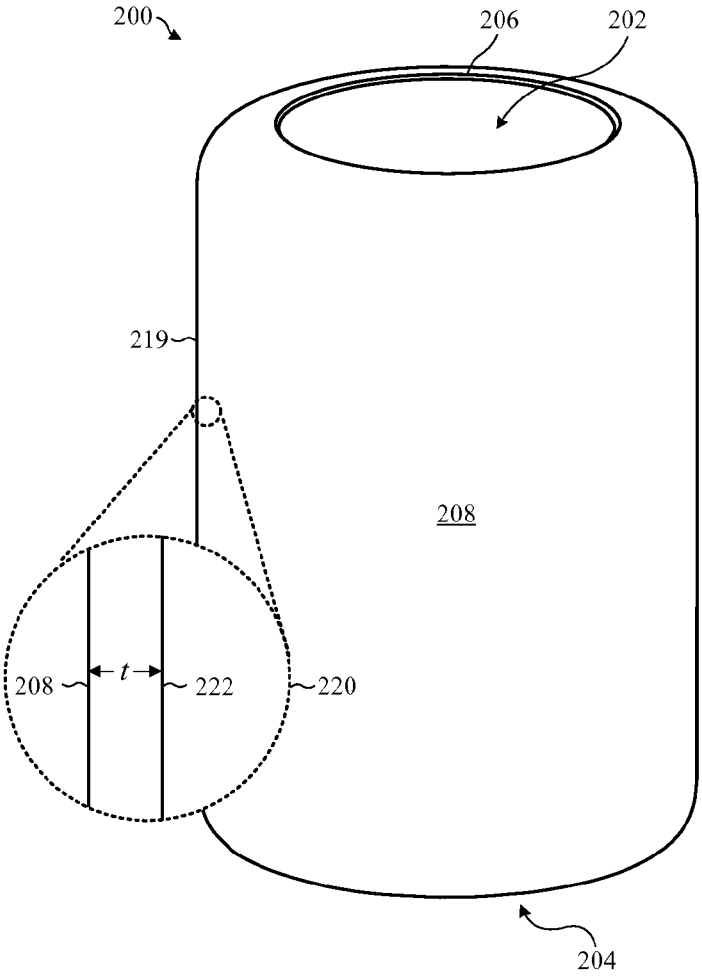
FIG. 2A shows a perspective view of a different workpiece that can undergo a finishing operation.

The techniques described in this paper can be used to monitor the thermal characteristics of a finishing operation on any suitable type of workpiece. In some embodiments, the workpiece is a housing for an electronic device, such as shown in FIG. 2A. FIG. 2A shows a perspective view of workpiece 200. Workpiece 200 can correspond to a housing for a computing device. Workpiece 200 can be cylindrical in shape, with a first opening 202 and a second opening 204 that is axially disposed from first opening 202. Workpiece 200 defines an internal volume suitable for housing electronic components of the computing device. First opening 202 can be defined by lip portion 206, and second opening 204 can be defined by a corresponding lip portion (not shown). Workpiece 200 can be made of any suitable material, including metal (e.g., stainless steel or aluminum alloy), plastic, ceramic, glass or a combination thereof. In one embodiment, workpiece 200 is made of a metal alloy. Exterior surface 208 can be curved in accordance with a cylindrical shape of workpiece 200. In some embodiments, exterior surface 208 is finished in order to provide a cosmetically appealing mirror-like shine to workpiece 200. A section view of a portion of wall 219 of workpiece 200 is shown in inset view 220. Inset view 220 shows interior surface 222 opposing and separated by exterior surface 208 by thickness t.

Figure 2B:
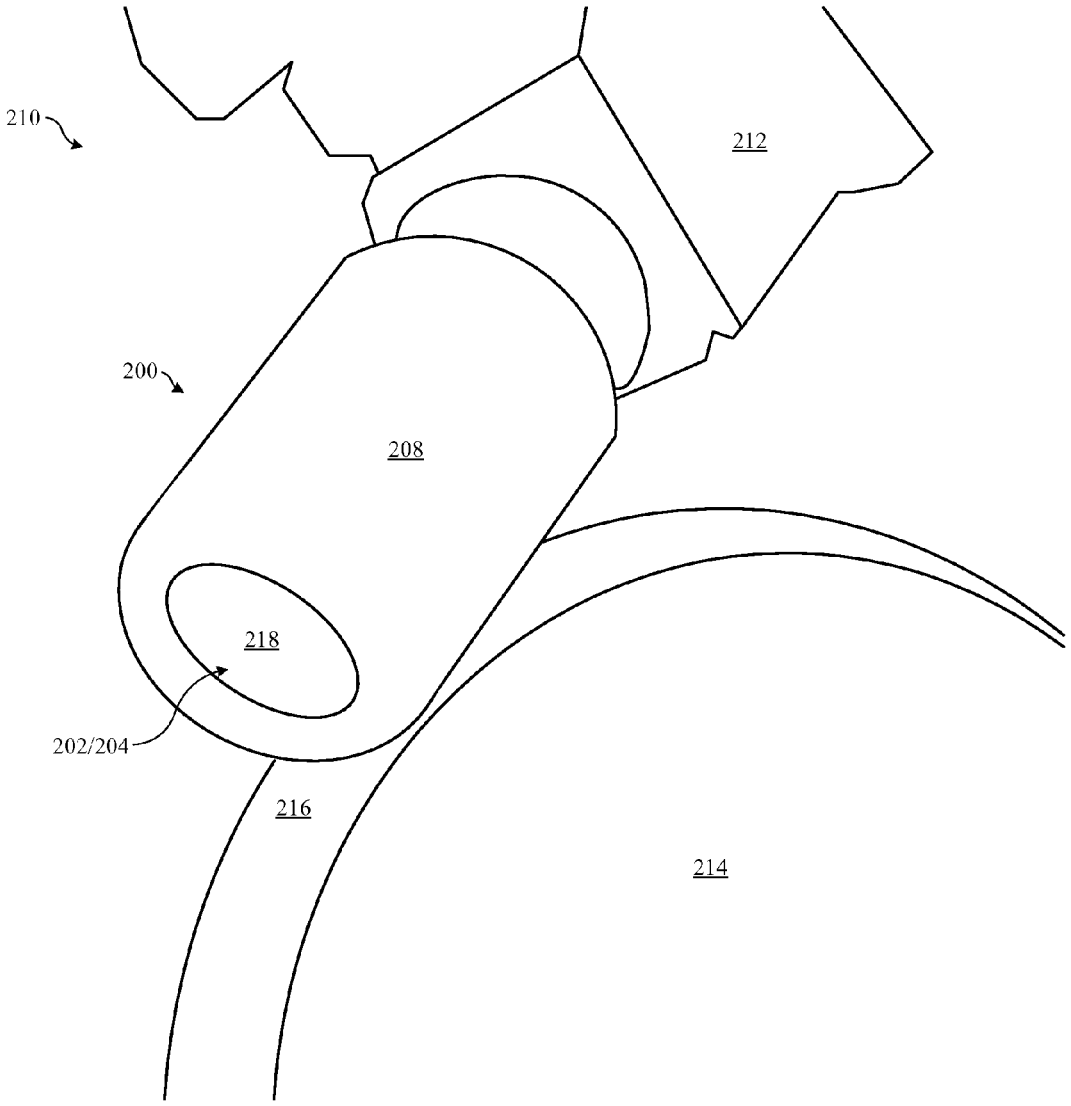
FIG. 2B shows a view of the workpiece of FIG. 2A during a finishing operation.

FIG. 2B shows workpiece 200 undergoing a finishing operation using a polishing apparatus 210, in accordance with some embodiments. Workpiece 200 is coupled with fixturing device 212 while polishing wheel 214 polishes exterior surface 208. Polishing wheel 214 rotates about a central axis and has an abrasive surface 216 that contacts workpiece 200 during the finishing operation. Polishing surface 216 can correspond to a material having abrasive particles embedded therein or a brush. Fixturing device 212 can be any suitable device capable of supporting and maneuvering workpiece 200 relative to polishing wheel 214 during the polishing operation. In some embodiments, fixturing device 212 is a multi-axis robotic arm capable of moving workpiece 200 in three-dimensions. Fixturing device 212 can include an end effector or gripper 218 that is configured to pass through the internal volume of workpiece 200. Gripper 218 can engage with interior surface 222 of workpiece 200 in order to secure workpiece 200 during the polishing operation. The operation of the fixturing device 212 and polishing wheel 214 can be controlled by a computer numerical control (CNC) application stored in a computer system.

As described above, the shiny surfaces can have low emissivities, thereby making it difficult to monitor the thermal characteristics of workpiece 200 during the polishing operation using traditional thermal techniques. Techniques described herein can be used to provide more accurate monitoring of thermal characteristics of a workpiece, such as workpiece 100 or workpiece 200, during a finishing operation compared to traditional techniques. The methods can involve modifying the workpiece surface, the abrasive surface, the lubricant, the thermal measurement technique itself, or a combination thereof in order to compensate for the low emissivity of the workpiece. In some embodiments, the techniques involve direct thermal measurements of a workpiece. In other embodiments, the techniques involve measuring other process parameters as a proxy for thermal measurements of the workpiece during the finishing operation. In some embodiments, a combination of direct and indirect thermal measurements is used.

Applying an Emissive Layer

Figure 3:
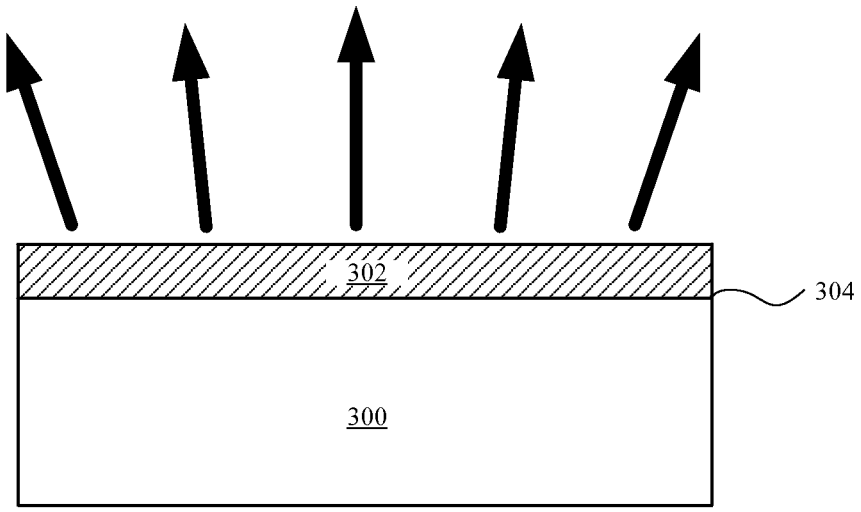
FIG. 3 shows a section view of a workpiece with an emissive layer.

According to some embodiments, a surface of a workpiece is modified to include an emissive layer. FIG. 3 shows a section view of workpiece 300, which includes an emissive layer 302 in accordance with some embodiments. Emissive layer 302 is positioned over surface 304 of workpiece 300 and is made of a material that has a higher emissivity than workpiece 300. Emissive layer 302 can be any substance that increases the emissivity of workpiece 300, such as dye, powder, paint, etc. Emissive layer 302 can be applied to workpiece 300 using a variety of techniques including painting, dyeing, ceramic layering, chroming, nitriding, and physical vapor deposition, or a combination thereof. In one embodiment, emissive layer 302 corresponds to an anodized layer that is infused with a dye that imparts a high emissivity to workpiece 300, which will be described in detail below with reference to FIGS. 4A-4C. The emissivity of emissive layer 302 can be monitored and collected as data during the finishing operation to provide information as to the thermal changes that workpiece 300 undergoes. The thermal radiation emitted by emissive layer 302 can be captured by an observer or by an imaging system. Note that emissive layer 302 can also be used to monitor and collect data during other types of machining operations and not just finishing operations. The machining operation can be any suitable operation or process that performs work on workpiece 300 that results in a change of thermal radiation emitted from workpiece 300.

Emissive layer 302 should have a threshold durability that prevents emissive layer 302 from substantially degrading or deteriorating during a subsequent machining operation. If emissive layer 302 is not sufficiently durable, a change in emitted thermal radiation captured by a thermal imaging camera can be caused by deterioration of emissive layer 302 rather than the work imparted on workpiece 300. The deterioration of emissive layer 302 can cause emissive layer 302 to have an unpredictable or varying emissivity for a particular temperature of workpiece 300. For this reason, a change in emitted thermal radiation due to the deterioration of emissive layer 302 can mislead an observer to believe the change is due to a change in temperature at workpiece 300.

Figure 4A:
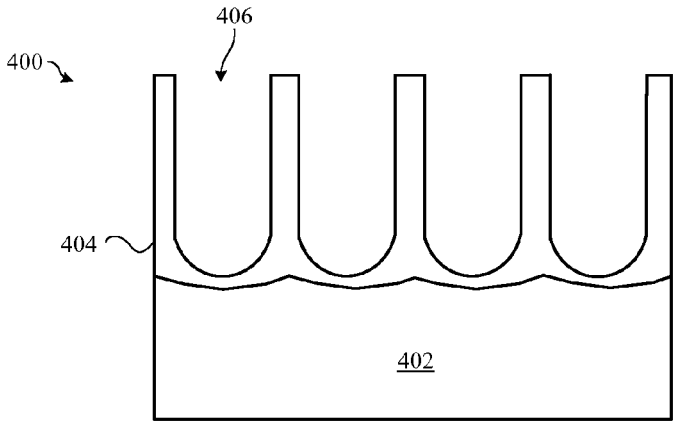
FIGS. 4A-4C show section views of a workpiece undergoing application of an oxide layer as an emissive layer.
Figure 4B:
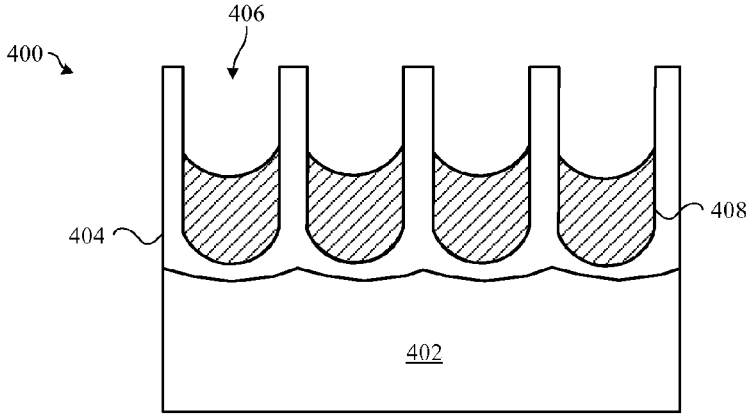
Figure 4C:
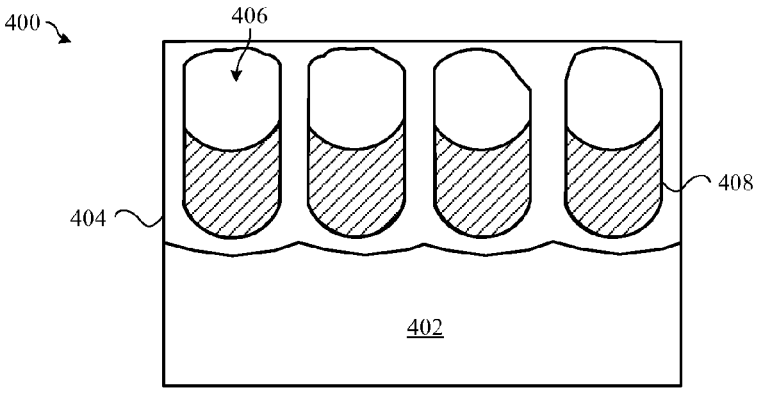

FIGS. 4A-4C show section views of a portion of workpiece 400 undergoing application of an oxide layer as an emissive layer, in accordance with some embodiments. In this embodiment, the emissivity of workpiece 400 is increased by performing an anodizing and dyeing process. Workpiece 400 can be made of any suitable anodizable material, such as aluminum and aluminum alloys. FIG. 4A shows workpiece 400 after an anodizing process where a portion of substrate 402 is converted to its corresponding oxide, forming oxide layer 404. For example, a substrate 402 made of an aluminum alloy can form an aluminum oxide layer 404. Oxide layer 404 can be formed using any suitable oxidizing technique. For example, an oxidation process can include submerging workpiece 400 in an electrolytic bath, such as a sulfuric acid bath, and passing a direct current through the electrolytic bath until a desired oxide layer thickness is formed. This process is typically referred to as anodizing. Anodizing will generally result in pores 406 forming within the oxide layer 404. In one aspect of the embodiment, substrate 402 may have undergone any number of processes prior to the oxidation, such as a cleaning or etching process. In another example, substrate 402 may have undergone a polishing process to provide substrate 402 with a mirror-like finish, resulting in substrate 402 having low emissivity. In some embodiments, the thickness of oxide layer 404 is adjusted to allow deep infusion of dye within oxide layer 404 in a subsequent dyeing process such that the dye is not machined away prior to the finishing operation being complete.

FIG. 4B shows workpiece 400 after a pore infusion dyeing process to insert dye 408 within anodic pores 406. Any of a number of suitable pore dyeing processes can be used, including electrolytic dyeing, integral coloring, organic dyeing and interference coloring. Dye 408 can be any suitable dye that increases the emissivity of aluminum workpiece 400. In one embodiment, dye 408 is a dark color, such as black. For example, dye 408 can be a black colored dye made of inorganic material, such as ferric ammonium oxide. In another example, dye 408 is a black organic dye. FIG. 4C shows workpiece 400 after a sealing process is applied to close anodic pores 406. Consequently, dye 408 can be sealed within the oxide layer 404. The sealing process and anodic pores can cooperate to protect dye 408 from corrosion and deterioration, particularly during a material removal (surfacing) operation performed on workpiece 400. Upon completion of formation, dyeing and sealing of oxide layer 404, the emissivity of workpiece 400 is increased and dye 408 is sufficiently protected to survive a subsequent finishing operation.

In some embodiments, oxide layer 404 with dye infused therein corresponds to a treated surface of a sacrificial portion of workpiece 400. After the finishing operation is complete and oxide layer 404 serves its purpose as an emissive layer, the sacrificial portion of workpiece 400 can be removed from a remainder of workpiece 400 using, for example, a machining or laser etching process. In other embodiments, oxide layer 404 is located on a surface of workpiece 400 that is not actually finished, such as a surface that is sub-flush to a surface of workpiece 400 that undergoes the finishing operation.

It should be noted that since oxide layer 404 corresponds to an oxidized portion of substrate 402, oxide layer 404 has similar thermal conductivity to that of the underlying substrate 402. For example, an aluminum oxide layer can have similar thermal properties to that of an aluminum substrate. Because the aluminum oxide has a thermal conductivity similar to that of the aluminum, undesired thermal phenomenon can be prevented during a subsequent finishing operation. For example, when an emissive layer has a very low thermal conductivity relative to the thermal conductivity of a workpiece, heat will travel more slowly through the emissive layer, whereas heat spreading beneath the emissive layer will travel more quickly. By maintaining substantially similar thermal conductivity across the emissive layer and underlying substrate, conduction of heat throughout the workpiece can be more easily predicted, thereby allowing thermal distribution of heat within the workpiece to be accurately monitored.

Figure 5:
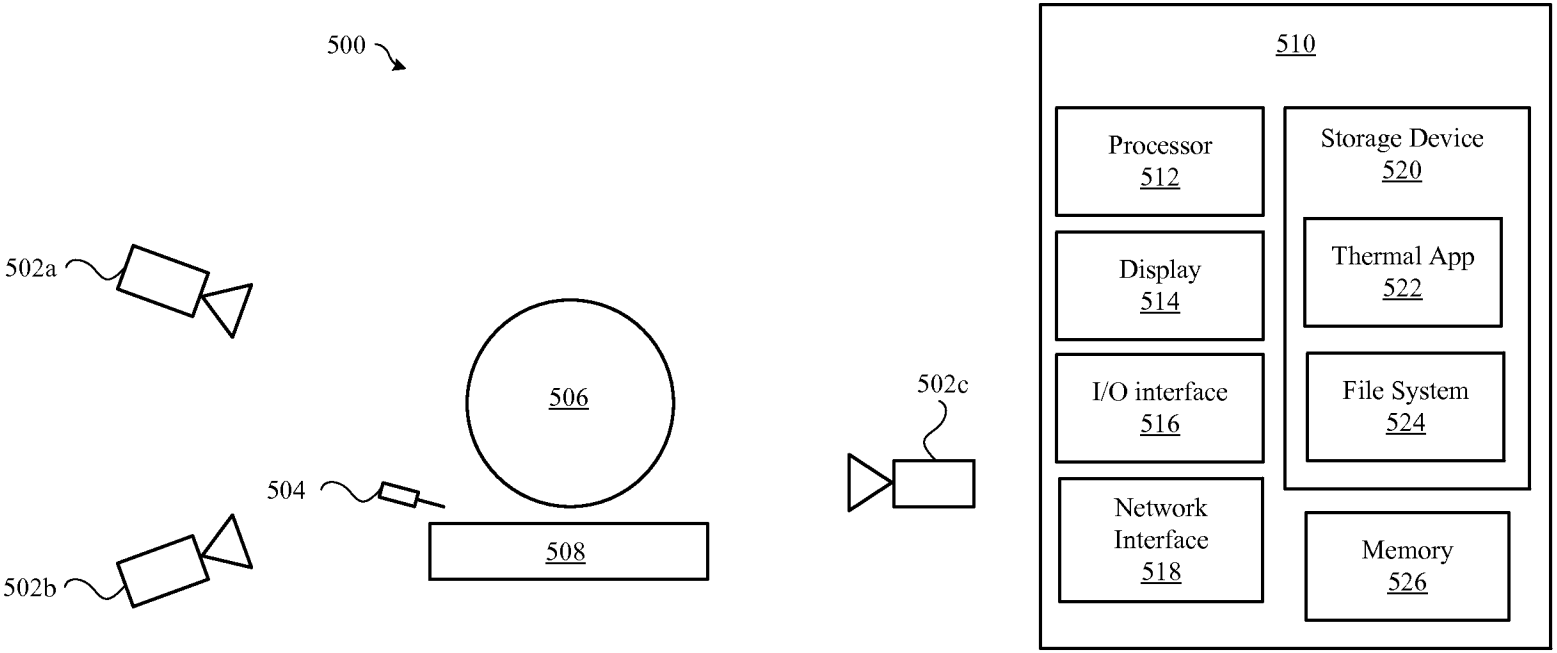
FIG. 5 shows a system for performing a finishing operation.

FIG. 5 shows system 500 for finishing workpiece 508, according to one embodiment. System 500 includes thermal imaging cameras 502*a*, 502*b*, 502*c*, thermal probe 504, surface finishing machine 506 and computer system 510. Thermal imaging cameras 502*a*, 502*b*, 502*c* can be orientated towards workpiece 508 and/or surface finishing machine 506. Thermal probe 504 can be disposed at any location and be configured to measure the location's temperature. Each thermal imaging camera 502*a*, 502*b*, 502*c* and/or thermal probe 504 can be independently operated or controlled using a master controller. For example, thermal imaging cameras 502*a*, 502*b*, 502*c* and thermal probe 504 can be controlled by computer system 510. Alternatively, any one of thermal imaging cameras 502*a*, 502*b*, 502*c* and/or thermal probe 504 can be manually controlled and moved by a machine operator. Surface finishing machine 506 can be any suitable machine that can perform an operation on workpiece 508. For example, surface finishing machine 506 can be a polisher, buffer, sander, blaster or grinder. Surface finishing machine 506 performs work on workpiece 508 that generates heat at workpiece 508, thereby increasing an amount of thermal radiation emitted from workpiece 508.

Depicted thermal imaging cameras 502*a*, 502*b*, 502*c* detect thermal radiation emitted by objects. Generally, the emitted thermal radiation cannot be seen with the human eye. A thermal imaging camera, along the lines of thermal imaging cameras 502*a*, 502*b*, 502*c*, can be configured to output a visual representation (usually in the form of an image or video) of the detected thermal radiation. This presentation can be accomplished in a number of different ways. Generally, the thermal imaging camera detects the radiation and correlates a thermal energy intensity with a particular visual wavelength of light. Typically, this visual representation uses variations of visible light to represent a range of detected thermal radiation, which in turn can be mapped to correspond to a range of temperatures. The variations of visible light can be represented by varying a property of visible light including, but not limited to: hues, shades, tones, tints, intensity, colors, brightness, darkness or a combination thereof. For example, one way to correlate the variations of visible light to thermal radiation is displaying a range of colors of a single hue (e.g., a monochromatic image such as gray scale image), where the hue changes gradually as a function of intensity. It should be understood that any property of visible light could be used to represent variations of visible light in a thermal image for the described embodiments.

An orientation of one or more thermal imaging cameras 502*a*, 502*b*, and 502*c* can be adjusted during a machining operation. This can be necessary if the operation requires workpiece 508 be moved in different positions. For example, workpiece 508 can be oriented in a different position in order to access a surface of workpiece 508 that is not accessible in its initial position. In one aspect of the embodiment, at least one thermal imaging camera is oriented or moved during all steps of the operation such that a particular part or surface of workpiece 508 is always observed. A thermal imaging camera's orientation can be adjusted manually by a user, automatically by a controller, or by some combination thereof.

Computer system 510 is a system for interfacing with and/or controlling thermal imaging cameras 502*a*, 502*b*, 502*c*, thermal probe 504, and/or surface finishing machine 506. Computer system 510 includes processor 512, display 514, input/output (I/O) interface 516, network interface 518, storage device 520 and memory 526. Processor 512 can be a microprocessor or controller for controlling the overall operation of computer system 510. Computer system 510 can store instruction data pertaining to manufacturing instructions in storage device 520 or memory 526. Storage device 520 can be a storage disk or a plurality of disks. Storage device 520 can include thermal application 522 and file system 524. File system 524 can store one or more pictures or videos captured by thermal imaging cameras 502*a*, 502*b*, 502*c* (i.e., thermal images). Furthermore, it can store data received from thermal probe 504 such as temperature readings. Thermal application 522 is an application that can be used to assist in analyzing a thermal image or video. Furthermore, thermal application 522 can be configured to control thermal imaging cameras 502*a*, 502*b*, 502*c*, thermal probe 504 and/or surface finishing machine 506. Embodiments of thermal application 522 are described in more detail herein.

I/O interface 516 allows a user of computer system 510 to interact with computer system 510. For example, I/O interface 516 can take a variety of forms, such as a button, keypad, dial, touch screen, mouse, audio input interface, visual/image capture input interface, input in the form of sensor data, etc. Display 514 (e.g., screen display) can be controlled by processor 512 to display information to the user. Network interface 518 is for communicating data with other devices. Accordingly, network interface 518 can be configured to communicate with thermal imaging cameras 502*a*, 502*b*, 502*c*, thermal probe 504, and/or surface finishing machine 506. For example, network interface 518 can be used to send control commands to a thermal imaging camera or surface finishing machine 506. Network interface 518 can be a wired interface and/or a wireless interface. In the case of a wireless interface, network interface 518 can include a wireless transceiver.

Note that computer system 510 is depicted in FIG. 5 as a single device for illustrative purposes only. The functionality and applications of computer system 510 as described above can be performed by two or more devices in communication with each other and/or in communication with thermal imaging cameras 502*a*, 502*b*, 502*c*, thermal probe 504, and surface finishing machine 506. For example, controlling surface finishing machine 506 can be performed by a computer numerical control (CNC) system, controlling thermal imaging cameras 502*a*, 502*b*, 502*c* can be performed by a camera controller module, analyzing thermal images can be performed by a data acquisition computer, and the thermal images can be stored on a remote server. The aforementioned elements can be in communication with each other over one or more networks.

Figure 6A:
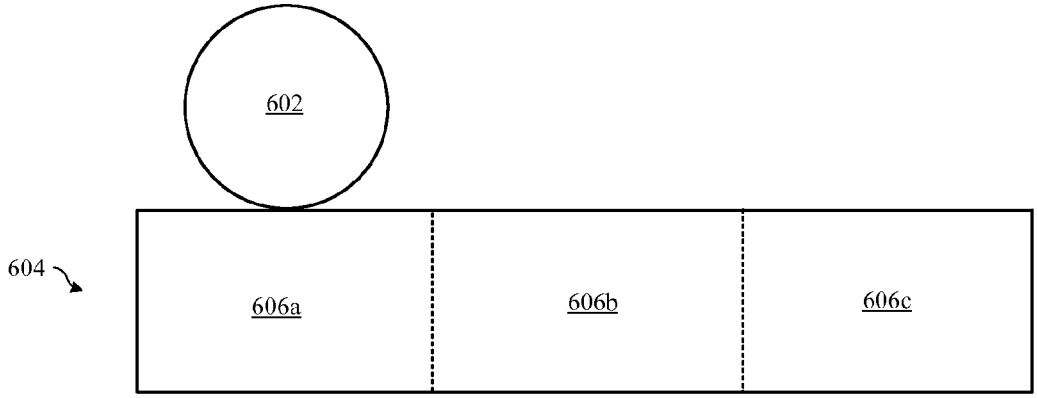
FIGS. 6A and 6B show a workpiece undergoing a finishing operation.
Figure 6B:
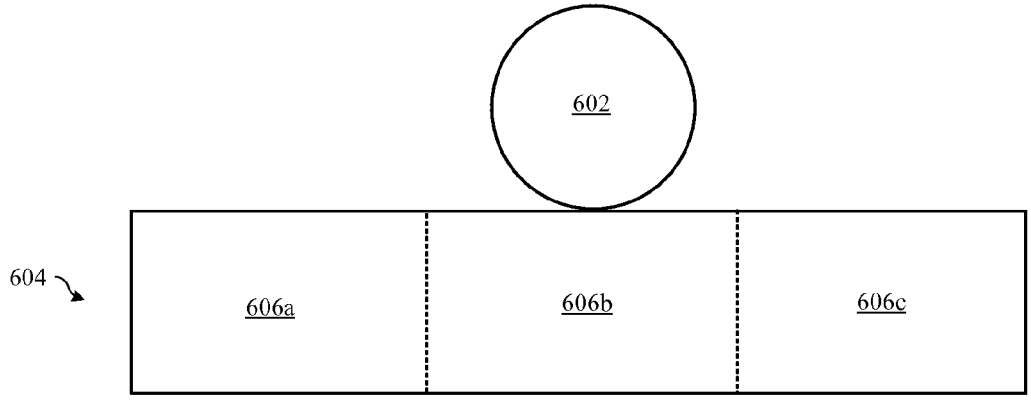

FIGS. 6A and 6B show workpiece 604 undergoing a polishing operation according to one embodiment. Workpiece 604 includes surfaces 606*a*, 606*b* and 606*c*, which represent different surface portions of workpiece 604 to be polished. It should be noted that workpiece 604 could be a workpiece that has undergone a process that formed an emissive layer across surfaces 606*a*, 606*b*, and 606*c*. FIG. 6A shows a top surface of a spinning polishing wheel 602 conducting a polishing operation across a surface 606*a* of workpiece 604. As polishing wheel 602 performs work on surface 606*a* for a first period of time, the temperature at and near surface 606*a* increases commensurate with an amount of time and energy applied by polishing wheel 602. Consequently, the thermal radiation emitted at surface 606*a* increases. Now referring to FIG. 6B, polishing wheel 602 continues to traverse workpiece 604 and polishes surface 606*b* for a second period of time. Accordingly, the temperature and emitted thermal radiation at and near surface 606*b* increases commensurate with an amount of time and energy applied by polishing wheel 602. In one aspect of the embodiment the second period of time is significantly less than the first period of time. Therefore, assuming a fixed rate of work input, polishing wheel 602 has exerted less work on surface 606*b* relative to the work exerted on surface 606*a*.

Figure 6C:
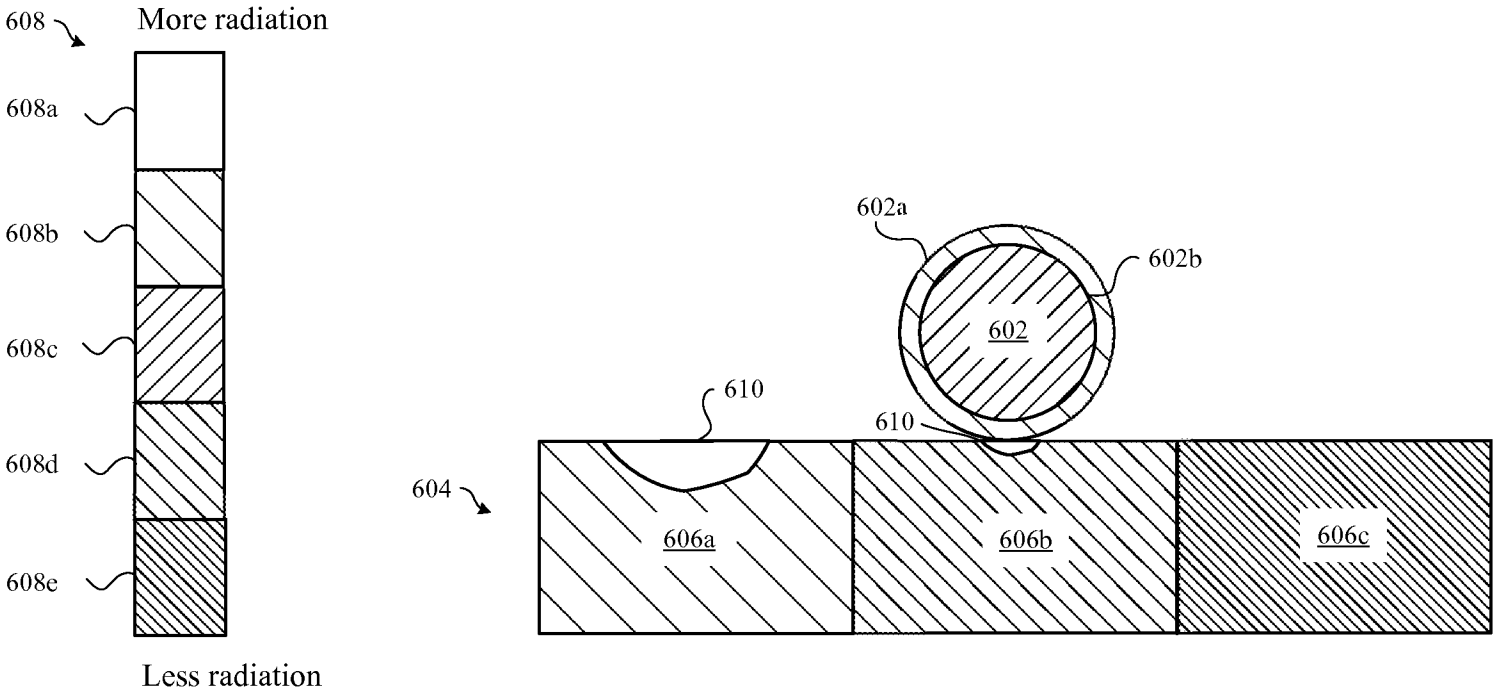
FIG. 6C shows a thermal-infrared representation of FIG. 6B.

FIG. 6C shows a thermal-infrared representation of the polishing steps as described above with reference to FIGS. 6A and 6B in which the second period of time is significantly less than the first period of time. In one embodiment, one or more thermal imaging cameras (e.g., 502*a*, 502*b* and/or 502*c*) capture the thermal-infrared representation of FIG. 6C during the polishing step shown at FIG. 6B. As shown in FIG. 6C, workpiece 604 and polishing wheel 602 each emit various amounts of thermal radiation. The various amounts of thermal radiation are represented using different shades in accordance with shading key 608. Shading key 608 includes shades 608*a*, 608*b*, 608*c*, 608*d*, and 608*e*, which correspond to varying amounts of detected thermal radiation.

Polishing wheel 602 includes perimeter portion 602*a* and central portion 602*b*. Perimeter portion 602*a* is in direct contact with workpiece 604 during the polishing operation and therefore more work is exerted on perimeter portion 602*a* than central portion 602*b*. Consequently, more thermal radiation is emitted near perimeter portion 602*a* than central portion 602*b*. Surfaces 606*a*, 606*b* and 606*c* each emit a different amount of thermal radiation, indicating different temperatures. Surface 606*a* emits the largest amount of thermal radiation relative to surfaces 606*b* and 606*c*. This can be due to the greater amount of work polishing wheel 602 performed on surface 606*a* relative to the other surfaces. Surface 606*b* emits the second largest amount of thermal radiation. Lastly, surface 606*c* emits the least amount of thermal radiation. This is expected as the polishing operation described above with reference to FIGS. 6A and 6B did not include polishing surface 606*c*. Accordingly, it can be deduced that surface 606*a* is the hottest of surfaces 606*a*, 606*b* and 606*c*. Furthermore, it can be deduced that a thermal gradient is distributed across workpiece 604.

FIG. 6C also shows hot spots 610 present at surfaces 606*a* and 606*b*. Hot spots 610 emit the largest amount of radiation relative to other surfaces of workpiece 604. Accordingly, hot spots 610 can indicate where polishing wheel 602 physically abraded workpiece 604. The brightness and size of a hot spot can be proportional to an amount of work performed at the hot spot. For example, the area of hot spot at surface 606*a* is larger than the area of hot spot at surface 606*b*. Accordingly, it can be deduced that a greater amount of work was performed at surface 606*a* than surface 606*b*. This is due to the longer period of time (first period of time) polishing surface 606*a* compared to the period of time (second period of time) polishing surface 606*b*.

Figure 7:
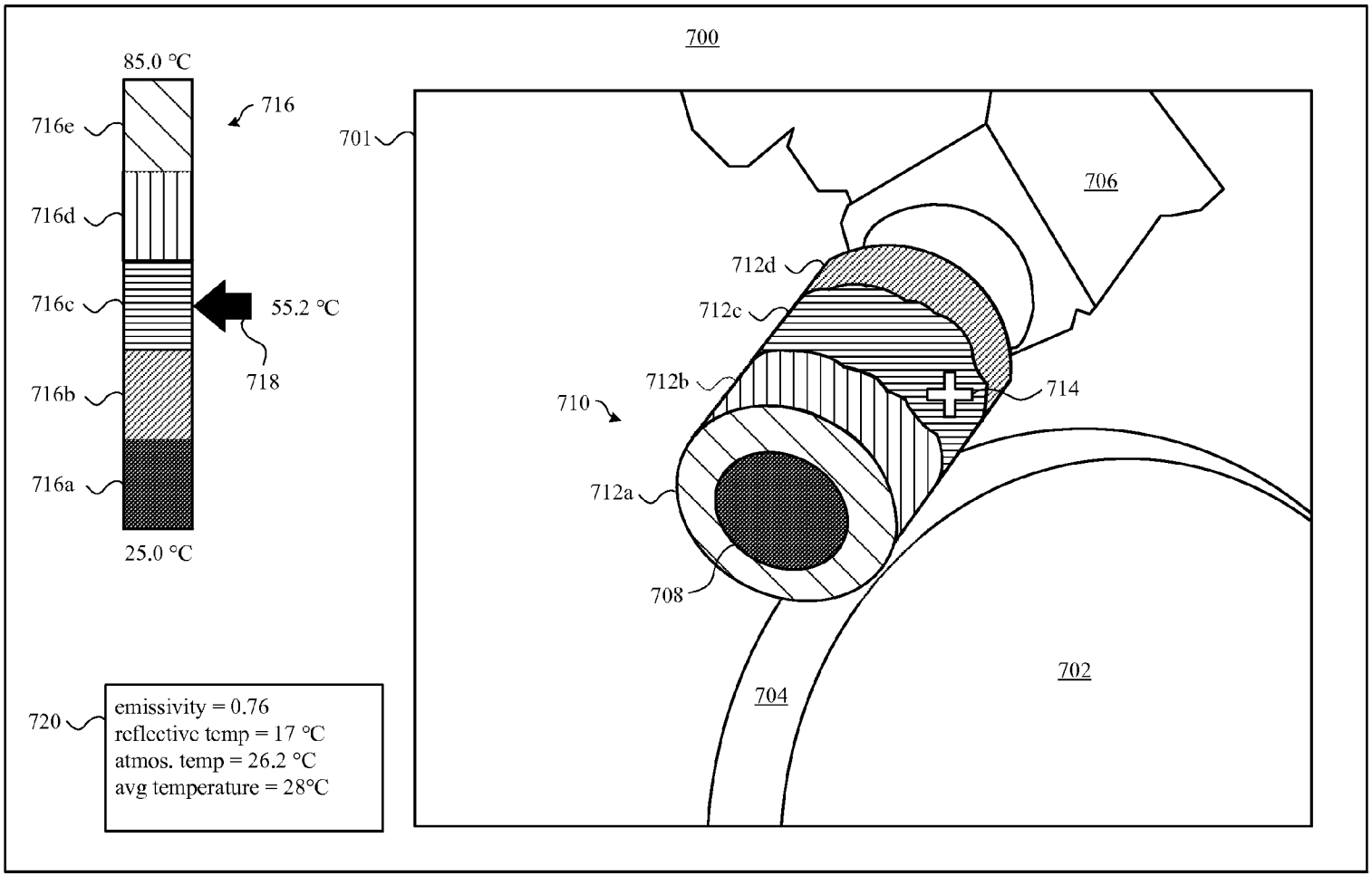
FIG. 7 shows a screen display of a thermal analysis application showing a thermal image of workpiece with an emissive layer during a polishing operation.

FIG. 7 is an exemplary screen display 700 of thermal application 522 according to one embodiment. As previously discussed, thermal application 522 is an application that can be configured to analyze a thermal image or video. In some embodiments, the thermal application 522 dynamically displays a thermal image or video during a polishing operation. Furthermore, thermal application 522 can be used to quantify and qualify thermal characteristics of a workpiece (and other objects participating in the operation) as it undergoes an operation such as polishing. The thermal characteristics can be used to detect defects, improve efficacy of the operation and provide insight that may not otherwise be visible or be easily detectable with the naked eye. Screen display 700 includes thermal image 701, temperature map 716, and dialogue box 720.

FIG. 7 shows a snapshot of thermal image 701 of a polishing operation in progress. In an alternative embodiment, screen display 700 can be representative of a real-time video display of a polishing operation or alternatively can be utilized to review various portions of the polishing operation. Any suitable thermal imaging device, such as thermal imaging cameras 502*a*, 502*b*, and/or 502*c*, can provide thermal image 701. Thermal image 701 depicts polishing wheel 702, fixturing device 706 and workpiece 710 during a polishing operation. Polishing wheel 702 can include an abrasive surface 704 for finishing workpiece 710. Fixturing device 706 can be a multi-axis robotic arm capable of moving workpiece 710 in three-dimensions. Gripper 708 can pass through a central portion of workpiece 710 to hold workpiece 710 during the polishing operation. Workpiece 710 can be made of any suitable material, including metal, glass, ceramic, plastic or a combination thereof. In some embodiments, workpiece 710 can be shaped into a cylindrical tube, similar to workpiece 200 described above. Workpiece 710 has undergone a procedure to increase its emissivity, such application of an emissive layer described above. In one embodiment, workpiece 710 has a dyed oxide layer as an emissive layer as described above with reference to FIGS. 4A-4C.

Workpiece 710 can have one or more surfaces 712*a*, 712*b*, 712*c* and 712*d*. Surface 712*a* is at one end of workpiece 710 while surfaces 712*b*, 712*c* and 712*d* are at the radial perimeter of workpiece 710. Fixturing device 706 is configured to move workpiece 710 in various positions relative to polishing wheel 702 such that one or more surfaces 712*a*, 712*b*, 712*c* and 712*d* can be polished. Temperature map 716 includes a range of shades that corresponds to a range of different temperatures. Taking temperature measurements and/or utilizing a baseline for a particular machining process can accomplish a correlation between emitted thermal radiation and temperature. In this embodiment, temperature map 716 takes the form of a bar displaying five shades 716*a*, 716*b*, 716*c*, 716*d*, 716*e*. However, it should be understood that this embodiment is not limiting and that temperature map 716 can take many other visual forms. For example, temperature map 716 can be any suitable presentation to show a correlation between shades, patterns or colors and temperatures such as a table, a graph, a chart, a swatch, etc. As shown in FIG. 7, temperature map 716 represents a temperature range from 25.0° C. to 85.0° C. In one embodiment, temperature map 716 can be adjusted such that only the range of temperatures present in thermal image 701 is represented in temperature map 716. In another embodiment, temperature map 716 can represent a range of temperatures greater than the range presented in thermal image 701. In yet another embodiment, temperature map 716 can indicate the largest temperature range that thermal application 522 and/or a thermal imaging device system is capable of detecting.

It should be noted that, for the purpose of clarity and conciseness, shading is shown only for workpiece 710 (surfaces 716*a*, 716*b*, 716*c*, 716*d*) and gripper 708 in thermal image 701. In a real thermal image, other objects (e.g., polishing wheel 702) in the image can represented with various degrees of shading. For example, the ambient background of thermal image 701 can be very dark in a real thermal image, as other objects in the room can have much lower temperatures and/or emissivity values. Also note that temperature map 716 includes five shades (716*a*, 716*b*, 716*c*, 716*d*, and 716*e*) for the purpose of illustration only. It should be understood that any suitable number of shades could be used.

In one embodiment, temperature map 716 can be mapped or "thermally tuned" such that each shade in temperature map 716 corresponds to a particular temperature or corresponds to a range of temperatures. To calibrate the mapping, one or more thermal probes such as thermal probe 504 can be used to take an initial temperature reading that is used as a baseline. For example, an operator can take an initial temperature reading of what he believes to be is the coldest object in the operation resulting in an initial temperature reading of 25.0° C. Next, the darkest shade in the temperature map 716, shade 716*a*, is mapped to a range of temperatures that includes 25.0° C., such as range [25.0° C. to 37.0° C.]. Alternatively, shade 716*a* can be mapped to only 25.0° C. Next, all other shades (716*b*, 716*c*, 716*e*) can then be mapped to a unique temperature or a unique range of temperatures. For example, shade 716*b* can be mapped to [37.1° C. to 49.0° C.], shade 716*c* to [49.1° C. to 61.0° C.], shade 716*d* to [61.1° C. to 73.0° C.] and shade 716*e* to [73.1° C. to 85.0° C.]. Any number of mapping schemes can be used depending on the user's preference or desired application. For example, in one case a user is only concerned when a thermal parameter, such as a threshold temperature, is exceeded. The user can calibrate temperature map 716 using a binary scheme where all temperature values exceeding a threshold temperature are mapped to one shade (e.g., white) and all temperature values below the threshold temperature are mapped to another shade (e.g., black).

As previously discussed, an emissivity of an outside surface of workpiece 710 has been increased in accordance with one of the aforementioned processes with an emissive layer that has sufficient durability such that it that does not degrade or deteriorate during the operation. That is, the emissivity of a surface of workpiece 710 at a particular temperature is substantially constant throughout the operation. Accordingly, the observed changes in thermal radiation that workpiece 710 emits is not due to the deterioration of the emissive layer. That is, an emissivity value does not vary during the operation for a particular temperature. In this sense, the correlation (i.e., mapping) between shadings and temperatures in the temperature map 716 is constant throughout the operation.

Crosshairs 714 can be used to select a spot on thermal image 701. In one embodiment, a user controlling input/output (I/O) interface 516 can determine the position of crosshair 714. For example, crosshairs 714 can represent a mouse pointer controlled by the user. Spot temperature 718 and dialogue box 720 provide the user with information related to the selected spot. Spot temperature 718 indicates the temperature at the selected spot. Dialogue box 720 can include information not associated with the selected spot such as the average temperature of the entire thermal image 701. Dialogue box 720 can also include information associated with the selected spot including the emissivity, estimated reflective temperature, and atmospheric temperature at the selected spot. In this way, any object in thermal image 701 can be quantified, including portions of fixturing device 706 and polishing wheel 702.

In one embodiment, gripper 708 can be a multi-lobed gripper that also serves as a heat sink during the operation. For example, gripper 708 can be configured to receive heat from workpiece 710 during the operation, preventing workpiece 710 from becoming undesirably hot. According to temperature map 716, gripper 708 is relatively cool despite being surrounded by surfaces that indicate relatively high temperatures such as surfaces 712*a* and 712*b*; however, in some embodiments the actual temperature of gripper 708 can be about the same temperature as surfaces 712*a* and 712*b*. Hence, the temperature of gripper 708 in thermal image 701 can be misrepresented when an external surface of gripper 708 has a relatively low emissivity when compared to workpiece 710. For example, the low emissivity of gripper 708 can be due to gripper 708 being made from a mirror-polished metal.

In one aspect of the embodiment, observing how gripper 708 thermally interacts with workpiece 710 and other parts of multi-axis robotic arm 706 can be useful in quantifying and/or qualifying the polishing operation. For example, it can be useful to know when gripper 708 achieves a steady state of thermal exchange with its environment. Furthermore, it can be useful to know when the steady state is achieved between gripper 708 and surfaces 712*a* and 712*b*. In order to adequately observe gripper 708 using a thermal imaging device, the emissivity of the gripper 708 can be increased using one of the aforementioned techniques described herein.

Thermal application 522 can be used to detect a variety of thermal characteristics including rates of temperature changes, minimum temperatures, maximum temperatures, average temperatures, the presence of thermal gradients, how long a surface is at a particular temperature and other patterns in thermal conductivity. For each operation, these characteristics and other data described herein can be saved and stored. Thermal application 522 can include a learning algorithm that can identify patterns and characteristics from past operations. These patterns and characteristics can take the form of numerical data or visual data. For example, thermal application 522 can super-impose one or more thermal images and analyze the differences between each image. In another example, thermal application 522 can calculate a numerical average using data from past operations to determine variances and thresholds of a particular operation. Accordingly, certain patterns and characteristics associated with defects or undesired results can then be detected and prevented before they occur.

Table 1 below indicates steps for a polishing operation in accordance with one embodiment. In this embodiment, the polishing operation is performed on an exemplary embodiment of workpiece 710. Table 1 can be stored in file system 524 of computer system 510 or any other system that is configured to control one or more elements of the polishing operation such as a CNC system. Furthermore, Table 1 can be formatted and configured as machine-readable instructions that can be executed by a processor (e.g., processor 512) for controlling one or more machines that are used during the polishing operation (e.g., polishing wheel 702). Table 1 includes a STEP column, EVENT column, TIME column, LOCATION column, amount (AMT) column, and revolutions per minute (RPM) column. The STEP column represents the chronological order of the steps performed during the polishing operation. The EVENT column represents the type of event performed. For example, the event can be a polishing event in which a particular surface is polished, or a cooling event in which no action is performed and workpiece 710/polishing wheel 702 is/are allowed to cool down. Any other type of event suitable for a polishing operation can also be included. The TIME column represents the duration that each event takes place in minutes, however any other representation of time can be used. The LOCATION column indicates where the event will take place. For example, at STEP 1 a polishing event will take place at surface 712*b*. The AMT column represents the amount of polishing compound, such as wax, that is be used during a polishing event. In this embodiment, the amount of polishing compound is represented in ounces. In other embodiments, the amount can be represented in grams or pounds. The RPM column indicates how fast the polishing wheel will be rotated during a polishing event. It should be understood that the entries and columns in Table 1 are not limiting and that any polishing operation parameter known to one skilled in the art can be included.

TABLE 1

| STEP | EVENT | TIME | LOCATION | AMT | RPM |
|---|---|---|---|---|---|
| 1 | Polish | 7 minutes | 712b | 1 ounce | 1800 |
| 2 | Polish | 1 minute | 712c | 0.5 ounce | 1750 |
| 3 | Cooling | 2 minutes | — | — | — |
| 4 | Polish | 1 minute | 712b | 0.5 ounce | 1400 |
| 5 | Polish | 6 minutes | 712a | 0.5 ounce | 1800 |
| 6 | Cooling | 3 minutes | — | — | — |

As previously described, in response to detecting a thermal characteristic, a machine operator or controller can modify, add or skip any or all steps of a polishing operation associated with Table 1. In one embodiment, the RPM of the polishing wheel can be reduced. For example, the machine operator can reduce the RPM of the polishing wheel in response to detecting a thermal characteristic that indicates the polisher is in danger of overheating. In another embodiment, the time allocated for a certain event can be adjusted. For example, in response to detecting a thermal characteristic that indicates surface 712*a* is too hot, the time at STEP 5 can be reduced. Alternatively, more polishing consumable can be used in STEP 5 in an attempt to reduce the work performed on surface 712*a*. In another embodiment the time allocated for a certain event can be increased. For example, the duration of the cooling event of STEP 6 can be increased to ensure that workpiece 710 is safe to handle.

FIG. 8A shows a partial side view of a workpiece 800 having a surface defect 802 prior to a finishing operation. In one embodiment, workpiece 800 can be a workpiece having an emissive layer that increases its emissivity, as described above. Surface defect 802 can be excess material formed on a surface of workpiece 800. In some embodiments, in which workpiece 800 is a plastic workpiece made by injection molding, surface defect 802 can be excess plastic (also known as flash) formed during the injection molding operation. In other embodiments, in which workpiece 800 is a metal workpiece formed from two metal parts that are cast and/or molded, surface defect 802 can be a raised line of excess metal. The raised line can be due to minute inherent gaps between mating faces of a die or mold. It should be understood that the depiction of this embodiment is not limiting and that excess material forming surface defect 802 can take many other forms. For example, surface defect 802 can take the form of a parting line, sprue, a gate mark, an ejector pin mark and/or any other undesirable feature.

FIGS. 8B-8D show various configurations of workpiece 800 after different polishing operations. FIG. 8B shows an ideal surface where surface defect 802 is completely removed by a polishing operation. FIGS. 8C and 8D show workpiece 800 after a polishing operation that resulted in undesirable results. FIG. 8C shows workpiece 800 after an under-polishing operation in which surface defect 802 has been reduced but not entirely removed. FIG. 8D shows workpiece 800 after an over-polishing operation. Surface defect 802 has been removed; however an undesirable amount of material has also been removed at 804 due to over-polishing.

Figures 8E, 8F, 8G:
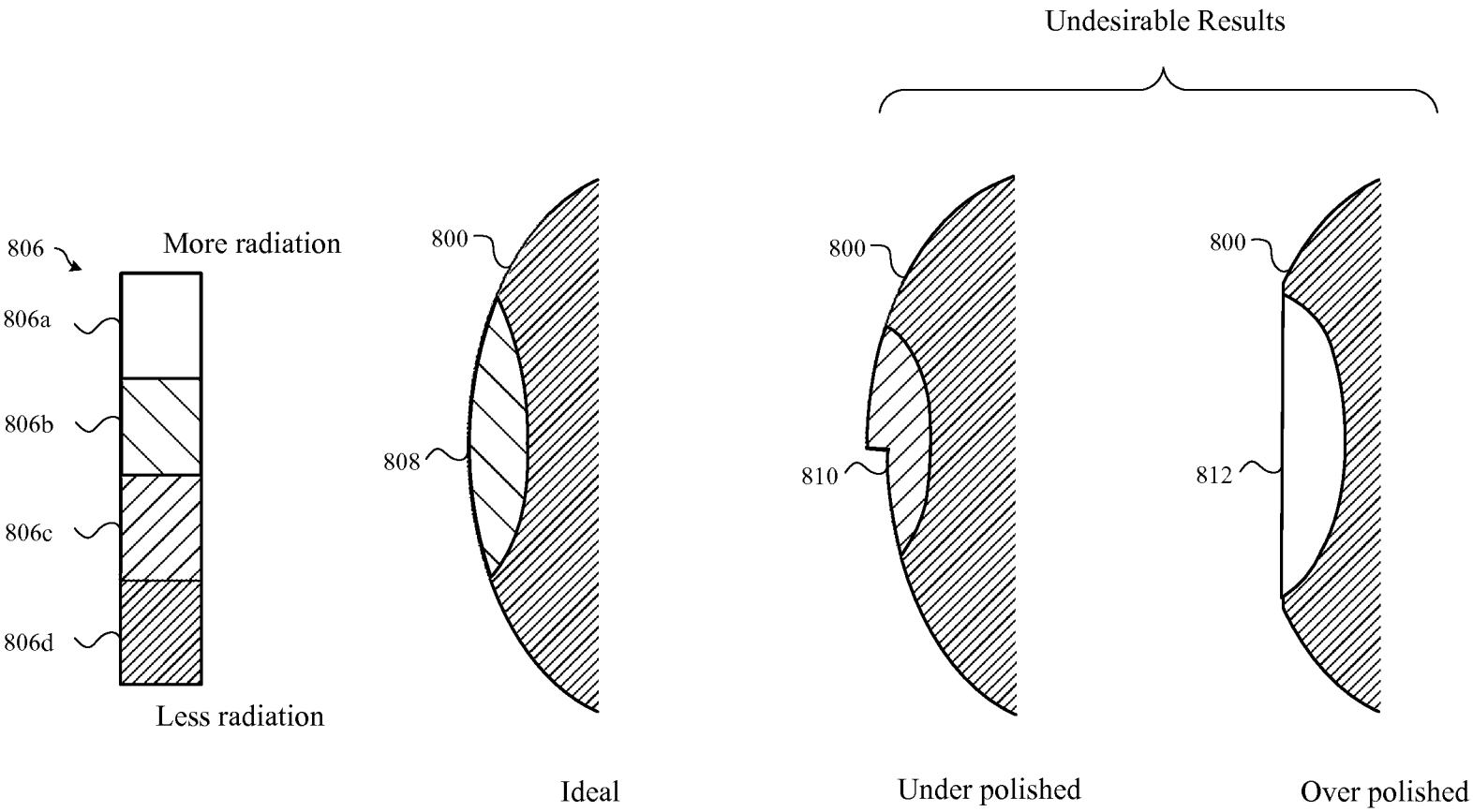
FIGS. 8E-8G show thermal-infrared representations of FIGS. 8B-8D respectively.

FIGS. 8E-8G show thermal-infrared representations of FIGS. 8B-8D respectively. The various amounts of thermal radiation are represented using different shades in accordance with shading key 806. Shading key 806 includes shades 806*a*, 806*b*, 806*c*, and 806*d* that represent varying degrees of emitted radiation. FIG. 8E shows workpiece 800 that includes a thermal signature associated with surface 808. Surface 808 emits thermal radiation that corresponds to an ideal amount of work that is performed on workpiece 800 during a polishing operation. Accordingly, the thermal characteristics of workpiece 800 as shown in FIG. 8E, particularly surface 808, indicates the polishing operation will achieve a desired result.

FIGS. 8F and 8G show polishing operations where a thermal signature associated with a particular surface of workpiece 800 correlates to a non-ideal outcome. FIG. 8F shows workpiece 800 having surface 810. Surface 810 includes a portion that emits less thermal radiation than surface 808. Since emitted thermal radiation can be proportional to the work performed, it can be deduced that surface 810 indicates not enough work was performed on workpiece 800 to achieve the desired result. Referring to FIG. 8G, it can also be deduced from the thermal signature associated with surface 812 that too much work was performed on workpiece 800. For example, surface 812 can include a hot spot emitting a correspondingly greater amount of thermal radiation than the hot spot depicted on workpiece 800 of FIG. 8E. As previously discussed, by observing and recording the thermal characteristics/signatures as shown in FIGS. 8E-8G, a desired thermal profile can be developed and used to improve the efficacy of future operations.

In one embodiment, a machine operator can observe a thermal image of workpiece 800 and modify the polishing operation on the fly to prevent undesirable results (e.g., FIG. 8F or FIG. 8G). For example, in response to observing the thermal profile of FIG. 8F during the polishing operation, the machine operator can prolong the polishing operation until a thermal profile similar to FIG. 8E is detected. In another example, in response to observing a thermal profile similar to FIG. 8E during the polishing operation, the machine operator can stop the polishing operation, preventing any over-polishing as depicted in FIG. 8D and FIG. 8G.

In another embodiment, a manufacturing system such as a CNC system can continuously monitor the operation and detect potential defects. In one aspect of the embodiment, the monitoring can occur as the operation occurs (i.e., in real time). In another aspect of the embodiment, the thermal images/video are saved and analyzed at a later time (i.e., after the operation is finished). The CNC system can include a learning algorithm that can detect defects based on past results. For example, the CNC system can identify patterns and anomalies that are associated with undesired results from past operations (e.g., FIG. 8F or FIG. 8G). Accordingly, the CNC system can automatically modify the steps in the operation in order to prevent or mitigate the defects.

Figure 9B:
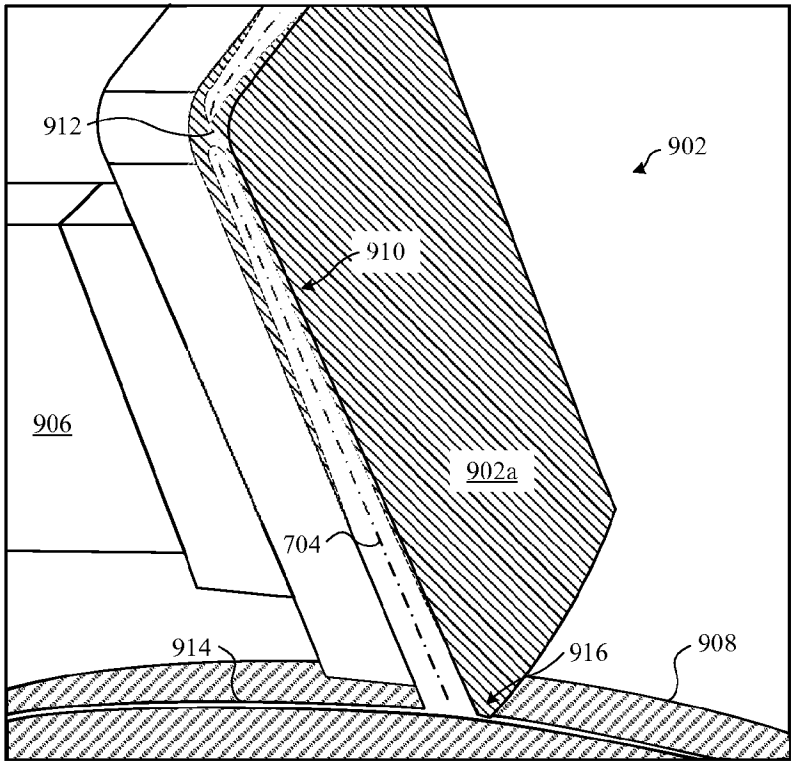
FIGS. 9A-9C show thermal-infrared representations of different polishing operations performed on a workpiece.
Figure 9A:
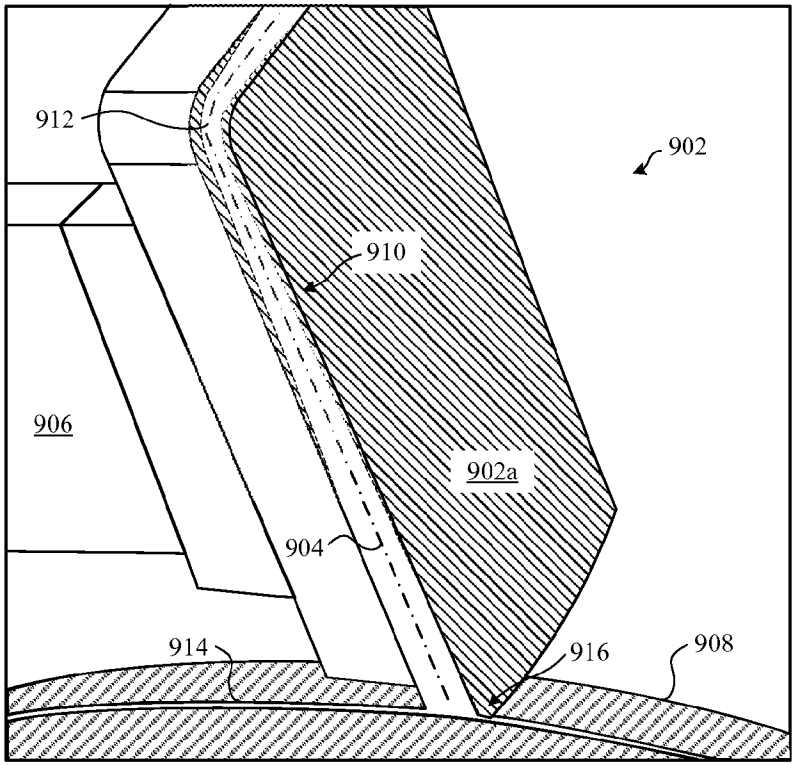
Figure 9C:
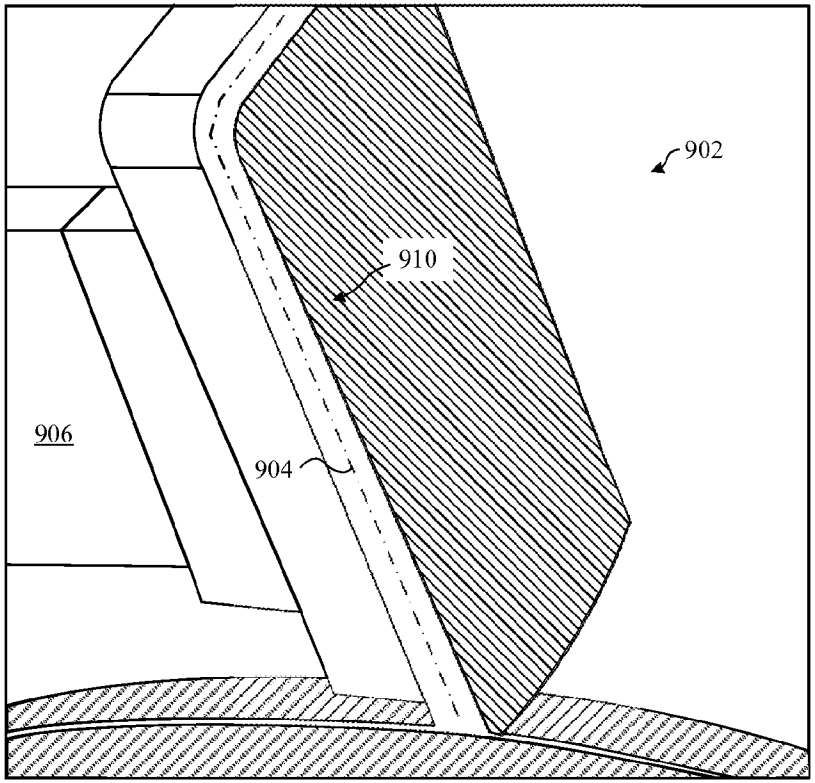

FIGS. 9A-9C show perspective views, provided by a thermal imaging device, of workpiece 902 undergoing a polishing operation to remove parting line 904. Like thermal image 701 as depicted in FIG. 7, for the purpose of clarity and conciseness, shading is shown for only workpiece 902 (including rear surface 902*a*, parting line 904, and lateral surface 910) and polishing wheel 908 (wheel stripe 914). Workpiece 902 can be an exemplary embodiment of any workpiece described herein. During the polishing operation, workpiece 902 is moved by robotic arm 906 such that polishing wheel 908 can polish different surfaces of workpiece 902. In this embodiment, robotic arm 906 rotates workpiece 902 such that polishing wheel 908 can polish workpiece 902 along a length of parting line 904 (as represented by a dashed line). While a parting line is depicted it should be noted that similar processes could be utilized to characterize removal of any defect disposed along a similarly oriented surface. The thermal images of FIGS. 9A-9C show lateral surface 910 surrounding portions of parting line 904. As a result of being subjected to polishing wheel 908, lateral surface 910 emits a substantial amount of thermal radiation relative to, for example, the thermal radiation emitted by rear surface 902*a*. Accordingly, an amount and shape of thermal radiation emitted from lateral surface 910 can indicate whether a proper amount of work was exerted upon parting line 904. As discussed below, observing a thermal signature associated with lateral surface 910, can help in determining if the operation's outcome will be desirable.

FIGS. 9A and 9B show polishing operations where a thermal signature associated with a particular surface of a workpiece correlates to a non-ideal outcome. In FIG. 9A, a thermal signature associated with lateral surface 910 shows a substantial drop in emitted thermal radiation at portion 912. It should be noted that the shading disposed along lateral surface 910 indicates a thermal signature. The reduction in emitted thermal radiation indicates an inconsistent amount of work was performed at portion 912 of workpiece 902. The reduction in emitted thermal radiation at portion 912 can occur due to inconsistent polishing along parting line 904. For example, one reason such a situation can occur is if the rotational velocity of polishing wheel 908 was reduced as it moved toward portion 912, resulting in an inconsistent amount of work performed along parting line 904. FIG. 9B shows a polishing operation that resulted in an even greater reduction in emitted thermal radiation at portion 912. In a thermal image, the emitted thermal radiation reduction at portion 912 can appear as a "black spot." In some embodiments, the presence of a "black spot" can be used to indicate if and where insufficient polishing (i.e., not enough work) occurred. For example, at portion 912 a "black spot" can occur due to the lack of sufficient pressure between workpiece 902 and polishing wheel 908 during the polishing operation. In one case, the insufficient pressure was due to inadequate positioning between robot arm 906 and workpiece 902 that resulted in workpiece 902 sparsely contacting polishing wheel 908 at portion 912.

FIGS. 9A and 9B also show wheel stripe 914 on a surface of polishing wheel 908. Wheel stripe 914 indicates an increased amount of emitted thermal radiation corresponding to a portion of the surface of polishing wheel 908 that contacts workpiece 902 during the polishing operation. Observations of wheel stripe 914 can give an observer better insight into the polishing operation. Similar to the aforementioned hot spots referenced above with respect to FIG. 6C, the location of wheel stripe 914 can indicate where the polishing wheel 908 is physically contacting workpiece 902 during the polishing operation.

Analysis of wheel stripe 914 can also provide information about a buildup of wax or polishing consumable on polishing wheel 908. The buildup tends to leave a "thermal residue," which refers to heat being absorbed by an area of excessive wax buildup or overly hardened wax, visible to a thermal imaging device on polishing wheel 908. Detection of a thermal residue is oftentimes associated with polishing a section of a smaller surface area, in this case the corner 916 of the workpiece 908. The wheel stripe 914 often indicates that the polishing wheel 908 achieves higher temperatures on the corner 916. In certain cases, when workpiece 902 is being polished on the lateral surface 910 (as opposed to the corner 916), the thin stripe can indicate a cool region where the polishing wheel 708 had been damaged from turning on the corner 916.

In terms of polishing consumable amount control, the temperature retention of the polishing wheel 908 can substantially affect a polishing operation. That is to say, the temperature can heat significantly upon momentary contact with the workpiece 902, but once the workpiece 902 is removed from the buffing surface, the polishing wheel 908 can rapidly cool down. This can also be observed when the part turns from buffing a long side to a corner (where initially the entire polishing wheel 908 is 'hot', and as the part turns corner 916, the rest of the polishing wheel 908 rapidly cools).

FIG. 9C shows a polishing operation where the thermal radiation emitted by lateral surface 910 is bright and uniform along parting line 904 representing an ideal polishing operation. That is, the thermal characteristics of lateral surface 910 correlates to a satisfactory and uniform removal of parting line 904. Thermal application 522 or a machine operator can use the thermal characteristics observed in FIG. 9C to develop a thermal profile for use in future polishing operation.

Figure 10:
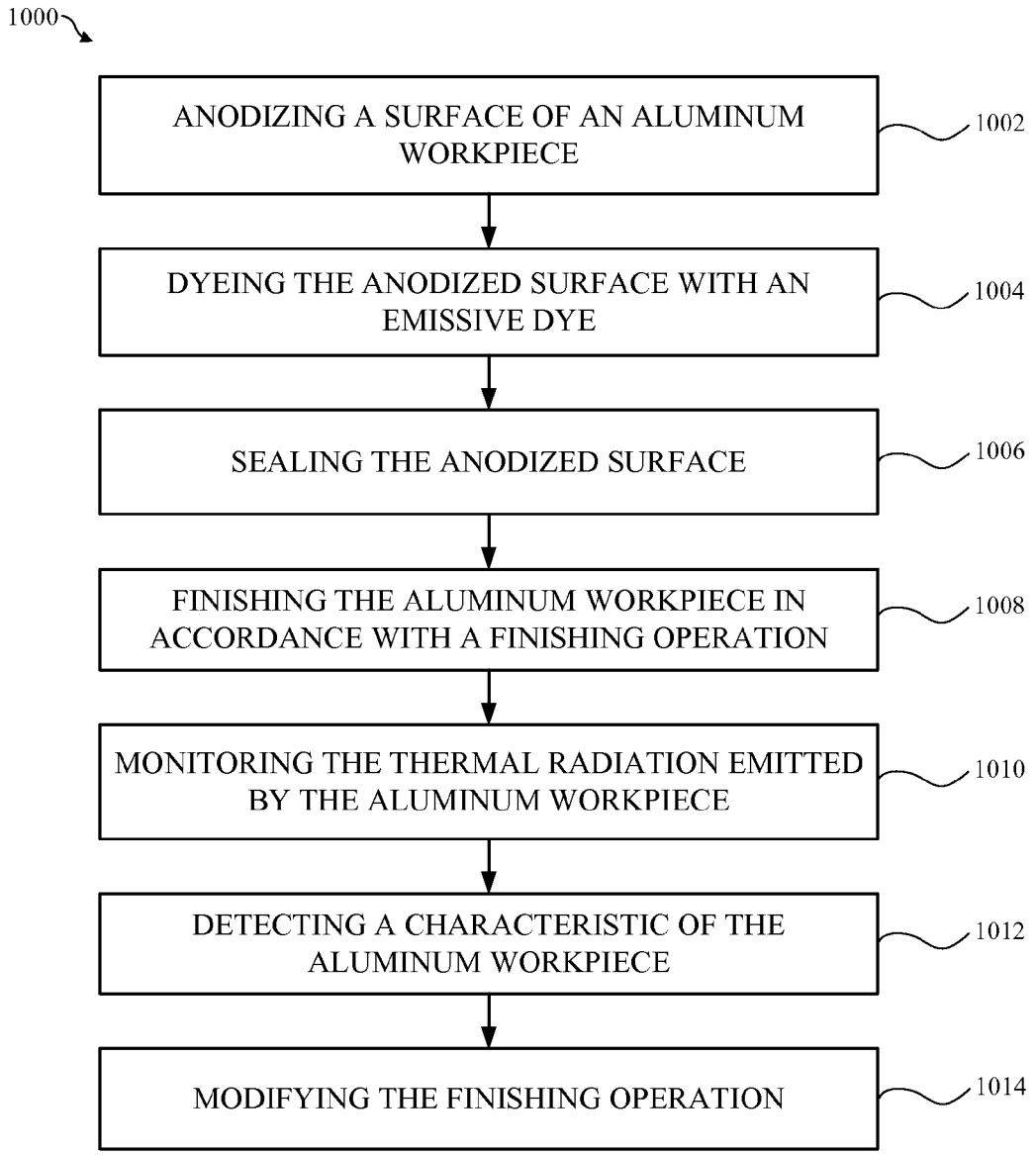
FIG. 10 shows a flowchart detailing a process that includes the use an oxide layer as an emissive layer.

FIG. 10 shows a flowchart detailing a process 800, which includes formation of an oxide layer as an emissive layer on an aluminum workpiece in accordance with the some embodiments. Process 1000 can be carried out with an anodizing system, polisher, thermal-infrared imaging system, machine operator, data acquisition system and/or CNC system, as described above. Process 1000 begins at 1002, where an aluminum workpiece undergoes an anodizing process in order to create an aluminum oxide layer. The anodized surface can include an oxide layer having a plurality of pores. At 1004, applying an emissive dye to the oxide layer increases the emissivity of the anodized surface. Next, the anodized surface undergoes a sealing process, protecting the emissive dye within the oxide layer at 1006. At 1008, the aluminum workpiece is polished in accordance with a finishing operation. Throughout the polishing procedure, the emissive dye does not substantially degrade or deteriorate such that the dyed surface maintains a substantially stable emissivity value at a given temperature.

During the polishing procedure, the thermal radiation emitted by the aluminum workpiece is monitored at 1010. The monitoring can be accomplished in part by using a thermal imaging camera. At 1012, a thermal characteristic of the aluminum workpiece is detected. The detected thermal characteristic can indicate the finishing operation will result in an undesirable result such as a defect. Lastly, in response to detecting the thermal characteristic, the finishing operation is modified in order to improve the efficacy of the finishing operation (i.e., prevent defects from occurring) at 1014.

Figure 11:
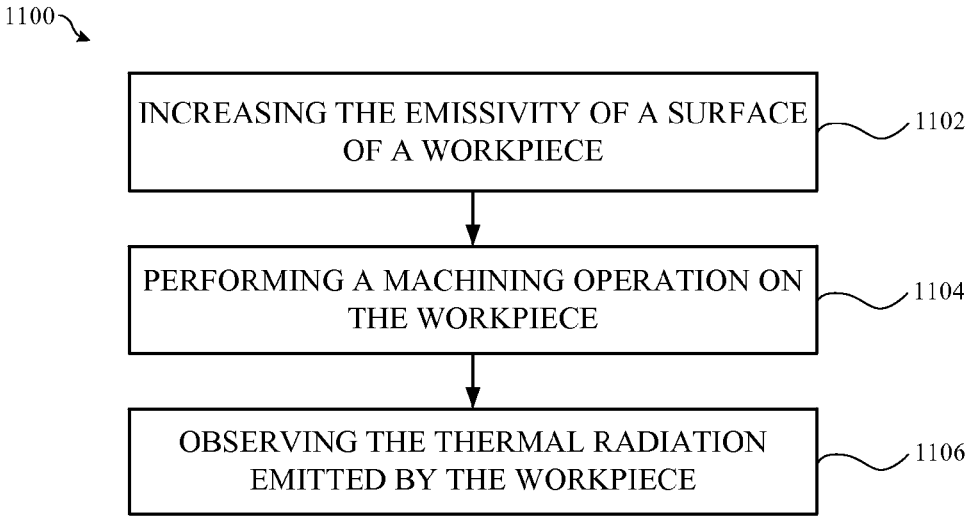
FIG. 11 shows a flowchart detailing a process that includes the use of an emissive layer for thermal characterization of a general machining process.

FIG. 11 is a flow chart detailing a general process 1100 for observing the thermal radiation emitted by a workpiece having an emissive layer during a machining operation. Process 1100 begins at 1102, where an emissivity of a surface of a workpiece is increased. The workpiece can be any type of metal suitable for use in a finishing operation. For example, the workpiece can be made from aluminum, steel, brass, copper, iron or a mixture containing a metal element such as a metal alloy. In another example, the workpiece can be made from plastic, glass or ceramic. In one embodiment, the workpiece can contain discrete parts that are coupled together (e.g., welded). The discrete parts can be made from different material. For example, the workpiece can have a combination of metal, plastic, glass or ceramic parts, or the workpiece can have a combination of different metal, different plastic, different glass or different ceramic parts. In another embodiment, the workpiece is formed from a single piece of material. Furthermore, the workpiece can be used in an electronic device, as described above. For example, the workpiece can be a housing enclosure for a computer, tablet, or mobile phone.

Applying an emissive layer on a surface of the workpiece increases the emissivity of the workpiece. The emissive layer can be a substance, such as a dye or powder that increases the emissivity of the workpiece when applied. Furthermore, the emissive layer can be a discrete layer over a surface of the workpiece and/or an integrated layer that mixes with the underlying surface of the workpiece. The emissive layer can be applied to the workpiece by any suitable technique including, but not limited to dyeing, painting, powder coating, ceramic emissive layer, black chroming, diamond-like carbon (DLC) coating, physical vapor deposition (PVD), plasma spraying, detonation spraying and flame spraying. If the workpiece is made from an anodizable material, the emissive layer can be an anodized oxide layer, as described above.

To achieve a consistent and stable thermal representation of the workpiece during the machining operation, the emissive layer should be sufficiently durable to survive the machining operation. That is, the emissive layer should withstand the work imparted on it during the machining operation such that the emissive layer does not substantially degrade or deteriorate during the machining operation. In some embodiments, it is preferred that the emissive layer have thermal conductivity properties similar to the underlying substrate (of the workpiece) so that observed thermal radiation accurately represents heat transfer.

In one embodiment, the emissive layer is only applied to a particular surface of the workpiece rather than the entire workpiece. This can be desirable when, for example, only that particular surface is observed during the machining operation. In another embodiment, emissive layers can be applied to two or more surfaces using different substances and/or techniques. Using a variety of substances and techniques can be useful when a workpiece is made from different material. For example, a first surface can have an underlying substrate of aluminum that is suitable for anodizing and a second surface can have an underlying substrate of a ferrous metal that flakes or peels when anodized. Accordingly, an emissive layer can be applied to the first surface using dye during anodizing and another emissive layer can be applied to the second surface using a technique other than anodizing, such as plasma spray coating. In one aspect of the embodiment, emissive layers can be applied to the first and second surfaces using different variations of the same technique. For example, a first surface is dyed after an anodizing process that uses a sulfuric acid bath while a second surface is dyed after an anodizing process that uses a nitric acid bath. Accordingly, any combination of substances, techniques, and variations of techniques can be used to apply an emissive layer to one or more surfaces of the workpiece.

At 1104 a machining operation is performed on the workpiece. The machining operation can be performed by fully be a machine or by a machine in combination with a worker or laborer. The machining operation can be any operation or process that performs work on the workpiece that results in a change of thermal radiation emitted from the workpiece. In one embodiment, the machining operation is surface finishing operation where a surface of a workpiece is continuously abraded such as polishing, buffing, brushing, sanding or burnishing. The work (e.g., friction from abrading) performed on the workpiece causes the temperature at the workpiece to increase, which in turn increases the thermal radiation emitted from the workpiece. In some embodiments, the machining operation involves drilling, milling, shaping, cutting, or a combination thereof.

In one aspect of the embodiment, the operation is performed on one or more surfaces where an emissive layer is applied. In another aspect of the embodiment, the operation is performed on a surface where an emissive layer is not applied. In some cases, it can be unsuitable or undesirable to apply an emissive layer to a particular surface of a workpiece. For example, a machining operation can require that an extreme amount of work be performed on a particular portion of the workpiece. Accordingly, an emissive layer applied on the portion that would unlikely survive the operation.

Observing a first surface having high emissivity while the operation is performed on a second surface having lower emissivity can provide insight as to how work performed remote from first surface affects the first surface. For example, it can be observed how long it takes the first surface to reach a thermal steady state while the operation is performed on the second surface. Accordingly, an observer can qualify and/or quantify the operation by observing a surface with high emissivity even when work is performed at a surface having low emissivity (i.e., the work is not directly performed on a surface having an emissive layer).

At step 1106, the thermal radiation emitted during the operation is observed using one or more thermal imaging cameras. Using a thermal image provided by a thermal imaging camera, thermal characteristics associated with the workpiece and/or other operating machinery can be qualified and quantified. Thermal characteristics can include, but not be limited to, brightness, shape, size, gradients and uniformity on an object. These characteristics can be used to identify phenomena occurring at the workpiece. For example, the shape and size of a large bright spot (e.g., a hot spot) on the surface of the workpiece can indicate a lot of work was performed on that particular surface. Thermal characteristics can also be used to contrast and compare different parts/surfaces of the workpiece. For example, during the machining operation, if a surface continues to emit high levels of thermal radiation while an adjacent surface emits a relatively low level of thermal radiation, this can indicate the workpiece has weak thermal conductivity or that the emissive layer is wearing away too quickly at a particular spot.

Obtaining Thermal Measurements from a Different Location of the Workpiece

According to some embodiments, thermal measurements of the workpiece are obtained from a location of the workpiece different than the surface being finished. As described above, thermal measurements from a reflective surface (i.e., a surface of a workpiece being polished) can be difficult to obtain. Thus, taking thermal measurements from a different surface of the workpiece can avoid this difficulty. In some embodiments, the thermal measurements are taken using a thermal sensor, such as thermocouple, laser thermometer, thermostat, thermistor, or other suitable temperature-sensing device.

In some embodiments, the thermal sensor is configured to measure a temperature of a surface opposing the surface undergoing the finishing operation. For example, returning to FIGS. 2A and 2B, the thermal sensor can measure a temperature of interior surface 222 of workpiece 200. As described above, interior surface 222 opposes exterior surface 208, which undergoes the finishing operation. Temperature measurements of interior surface 222 can be correlated with corresponding temperatures of exterior surface 208. For example, prior to performing a finishing process, a first temperature measurement can be taken a location on interior surface 222 and a location on exterior surface 208 that is directly opposite the internal surface location. In this way, the polishing apparatus 210 can be calibrated to accurately correlate a temperature measurement of interior surface 222 with a corresponding temperature of exterior surface 208. The correlation will depend on a number of factors such as the type of material that workpiece 200 is made of, as well as thickness t of wall 219 separating interior surface 222 from exterior surface 208. Once calibrated, temperature measurements can be taken of interior surface 222 during the finishing operation to determine corresponding temperatures at exterior surface 208. Thus, recording temperature changes of interior surface 222 can act as a proxy for measuring temperature changes of exterior surface 208.

Figure 12A:
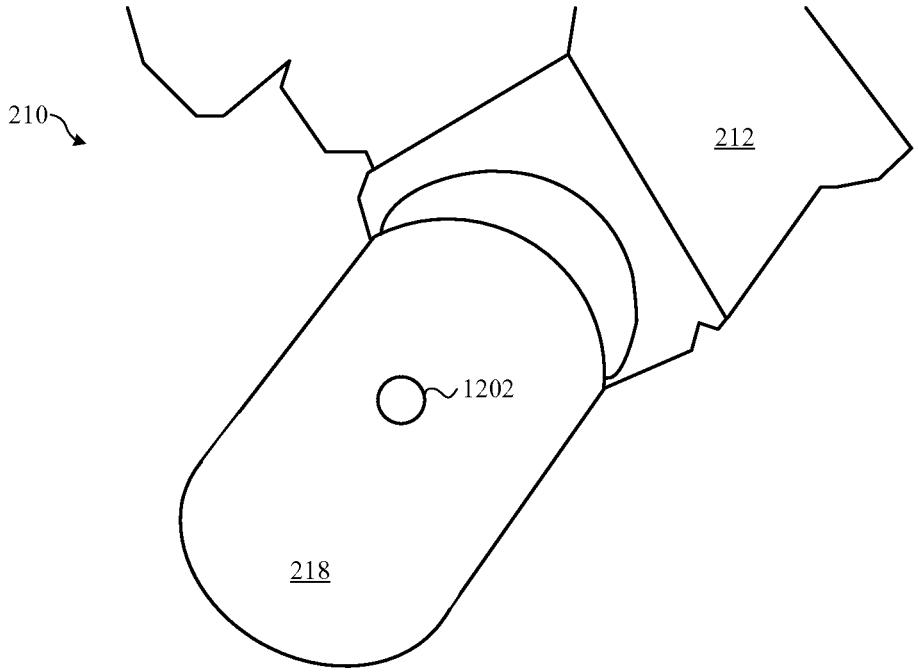
FIGS. 12A and 12B show different embodiments of the finishing apparatus of FIGS. 2A and 2B with thermal sensors.
Figure 12B:
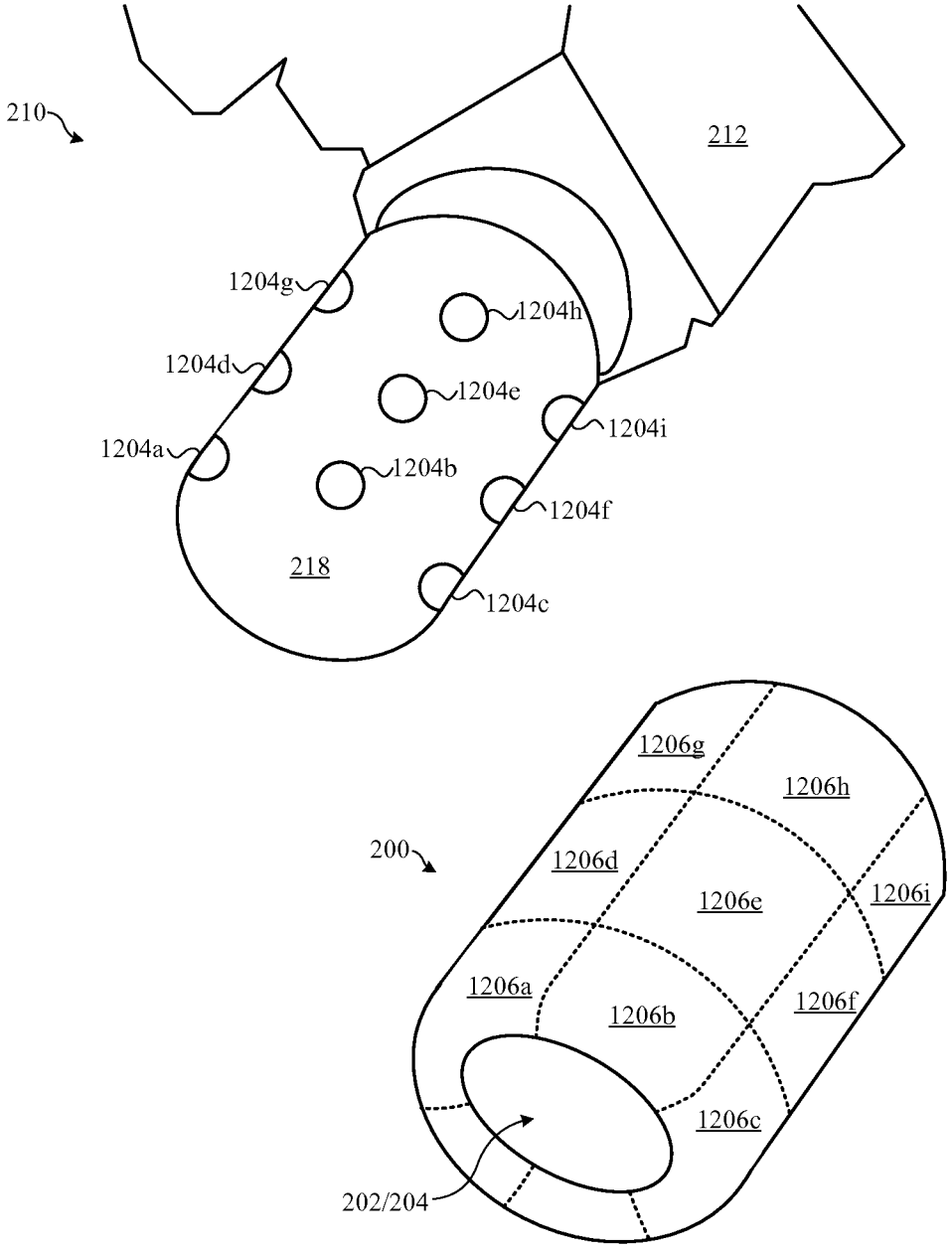

The temperature measurements of interior surface 222 can be accomplished by positioning a thermal sensor within the internal volume of workpiece 200. For example, the thermal sensor can be coupled to gripper 218, which can engage with and rotate with workpiece 200 during the finishing operation. FIGS. 12A and 12B show different embodiments of the apparatus 210 of FIG. 2B without workpiece 200 positioned thereon. FIG. 12A shows gripper 218 having a single thermal sensor 1202. Thermal sensor 1202 can be configured to contact and take temperature measurements of interior surface 222 of workpiece 200 during the finishing operation. The temperature changes recorded by thermal sensor 1202 can be correlated with corresponding temperature changes of exterior surface 208 of workpiece 200, as described above. In some embodiments, the temperature changes are displayed on a screen in real time using thermal application 522 to modify the finishing process on the fly. For example, if the temperature changes of exterior surface 208 are found to be too high, process parameters of the finishing operation can be adjusted to reduce the temperature at exterior surface 208. Examples of such process parameters will be described in detail below. In some cases, the CNC machine makes the adjustments automatically in response to the collected temperature data. In other embodiments, the temperature changes are saved as data in memory 526 and utilized to review a finishing operation.

FIG. 12B shows gripper 218 having multiple thermal sensors 1204*a*-1204*g*. The temperature readings from each of thermal sensors 1204*a*-1204*g* can be correlated and mapped with corresponding surface portions external surface portions 1206*a*-1206*g* of exterior surface 222 of workpiece 200. In this way, accurate thermal characteristics of different portions of workpiece 200 can be monitored during the finishing operation. In some embodiments, the temperature changes of the different external surface portions 1206*a*-1206*g* are displayed on a screen using thermal application 522, similar to screen display 700 described above with reference to FIG. 7. The images can be displayed during the finishing operation and used to adjust parameters of the finishing operation in real time. In some cases, the CNC machine makes the adjustments automatically in response to the collected temperature data. In some embodiments, the images are displayed after the finishing operation is complete to review various portions of the finishing operation. It should be noted that the number and locations of thermal sensors 1204*a*-1204*g* shown in FIG. 2B are exemplary and that any suitable number and locations of thermal sensors can be used depending on design requirements.

In some embodiments, temperature measurements from thermal sensors 1204*a*-1204*g* are grouped together and averaged. For example, temperature measurements of thermal sensors 1204*a*, 1204*b*, 1204*c* can be averaged to determine an average temperature of external surface portions 1206*a*, 1206*b*, 1206*c*. Likewise, temperature measurements of thermal sensors 1204*d*, 1204*e*, 1204*f* can be averaged to determine an average temperature of external surface portions 1206*d*, 1206*e*, 1206*f*. Similarly, temperature measurements of thermal sensors 1204*g*, 1204*h*, 1204*i* can be averaged to determine an average temperature of external surface portions 1206*g*, 1206*h*, 1206*i*. These averaged temperature measurements can be monitored and displayed using thermal application 522, as described above. Any suitable grouping of thermal sensors 1204*a*-1204*g* and external surface portions 1206*a*-1206*g* can be used depending on design requirements.

Measuring Thermal Characteristics of Abrasive Surface or Lubricant

According to some embodiments, thermal characteristics of the abrasive surface and/or the lubricant in a finishing operation are monitored. This can be done in addition to measuring thermal characteristics of the workpiece or instead of measuring thermal characteristics of the workpiece. As described above, it can be difficult obtain thermal emissions from a polished surface, such as the surface of a workpiece being finished. However, it may be possible to obtain thermal measurements of the abrasive surface performing the finishing operation or the lubricant applied to the workpiece/abrasive surface during the finishing operation. These thermal measurements can give indirect information as to the temperature of the surface of the workpiece. Thermal measurements of the abrasive surface and/or lubricant can be obtained using thermal imaging cameras directed at the abrasive surface and/or lubricant during the finishing operation. For example, returning to FIG. 5, one or more of thermal imaging cameras 502*a*, 502*b*, 502*c* can be adjusted to receive thermal images of an abrasive surface of surface finishing machine 506 and/or lubricant that is applied to surface finishing machine 506 and/or workpiece 508 during the finishing operation. In one embodiment, thermal imaging cameras 502*a*, 502*b* and/or 502*c* are infrared-thermal cameras configured to detect infrared light. The thermal image data collected by the thermal imaging cameras can be displayed using thermal application 522.

Figure 13:
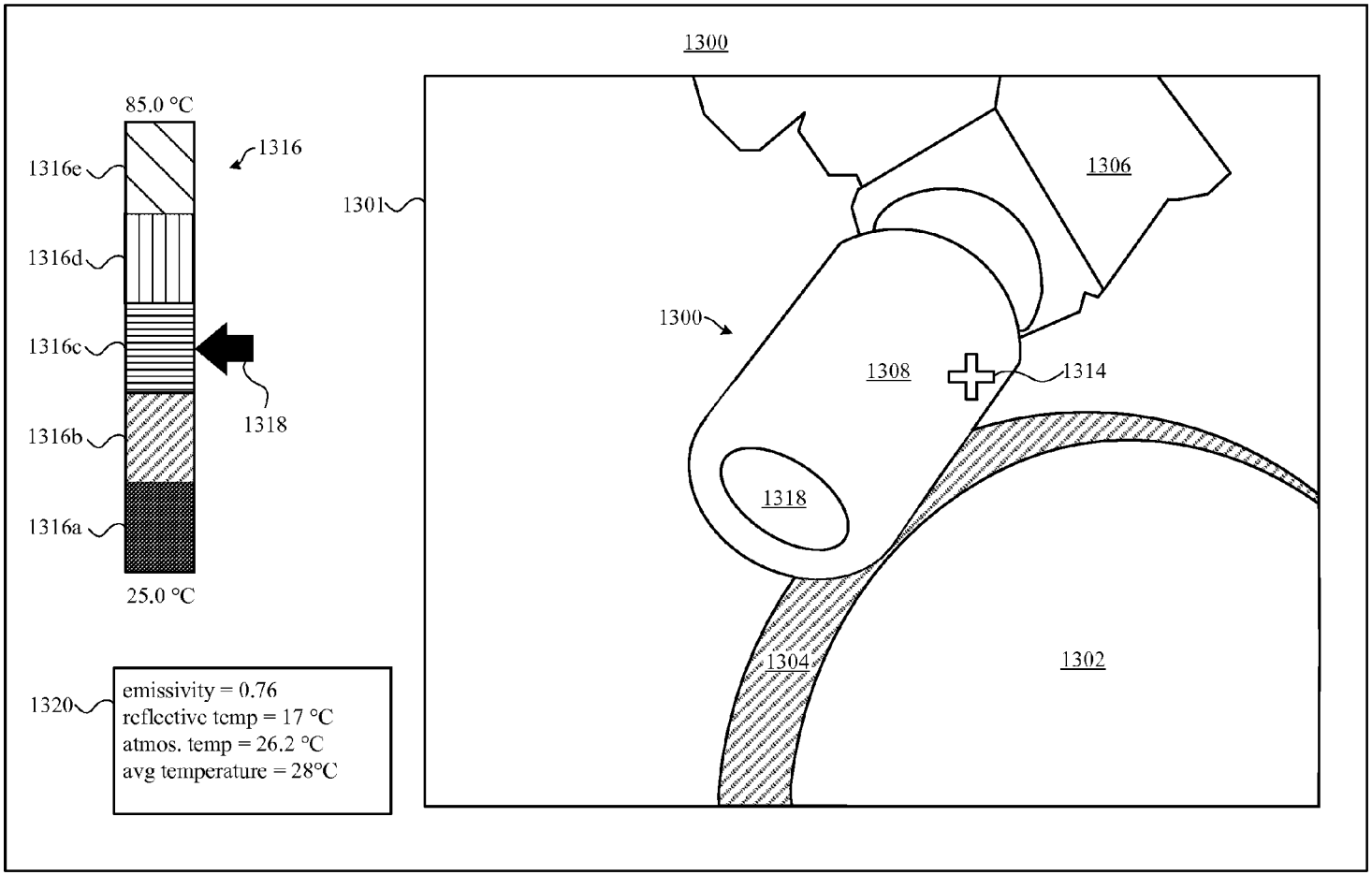
FIG. 13 shows a screen display of a thermal analysis application showing a thermal image of an abrasive surface and lubricant during a polishing operation.

FIG. 13 shows display 1300 with thermal image 1301 that can display information received by thermal imaging cameras 502*a*, 502*b* and/or 502*c* using thermal application 522 in accordance with some embodiments. Workpiece 1300 is coupled with fixturing device 1306 (e.g., multi-axis robot arm) via end effector or gripper 1318, which passes through an internal volume of workpiece 1300. Workpiece 1300 can be made of any suitable material, including metal, glass, ceramic, plastic or a combination thereof. Thermal image 1300 can be a real-time video display of a polishing operation or alternatively can be utilized to review various portions of the polishing operation. Thermal image 1301 shows external surface 1308 of workpiece 1300 undergoing a finishing operation, with thermal images of abrasive surface 1304 of polishing wheel 1302 during polishing operation. In some embodiments, abrasive surface 1304 has lubricant, such as wax, applied thereon to reduce friction between abrasive surface 1304 and external surface 1308. Thermal image 1301 shows abrasive surface 1304 as having a different shade than a remainder of polishing wheel 1302 due to heat brought about by the frictional force between abrasive surface 1304 and external surface 1308 of workpiece 1300. In some embodiments, the different shade of abrasive surface 1304 can correspond to a different color, as viewed by thermal image 1301.

Temperature map 1316 can be used to indicate a range of shades (e.g., colors) that correspond to a range of different temperatures. In this embodiment, temperature map 1316 takes the form of a bar displaying five shades 1316*a*, 1316*b*, 1316*c*, 1316*d*, 1316*e* corresponding to different temperature ranges, however it should be understood that this embodiment is not limiting and that temperature map 1316 can take many other visual forms. For example, temperature map 1316 can be any suitable presentation to show a correlation between shades, patterns or colors and temperatures such as a table, a graph, a chart, a swatch, etc. As shown in FIG. 13, temperature map 1316 represents a temperature range from 25.0° C. to 85.0° C.; however, any suitable temperature range can be displayed. Crosshairs 1314 can be used to select a spot on thermal image 1301, and spot temperature 1318 and dialogue box 1320 can provide the user with information related to a selected spot, such as described above with reference to FIG. 7.

FIG. 13 shows the shading of abrasive surface 1304 has a shading 1316*b* corresponding to a temperature range indicated by temperature map 1316. Temperature measurements of abrasive surface 1304 can be correlated with corresponding temperatures of external surface 1308. For example, a calibration finishing operation can be performed to measure different temperatures of abrasive surface 1304 with known corresponding temperatures of external surface 1308 of workpiece 1300. Once calibrated, the temperature measurements of abrasive surface 1304 can be relied upon to determine the temperature of external surface 1308 during subsequent finishing operations. In this way, monitoring temperature changes of abrasive surface 1304 can act as a proxy for monitoring temperature changes of exterior surface 1308.

In some embodiments, a temperature sensitive additive is added to the lubricant that is applied between abrasive surface 1304 and external surface 1308. The temperature sensitive additive can become more or less thermally emissive with temperature changes of the lubricant such that thermal imaging cameras 502*a*, 502*b* and/or 502*c* can capture these thermal changes on abrasive surface 1304. In some embodiments, a visible color change of the temperature sensitive additive is observable by an operator of the polishing apparatus without the aid of thermal imaging cameras 502*a*, 502*b* and/or 502*c*. For example, the temperature sensitive additive can change color when it reaches a predetermined temperature. When the lubricant reaches the predetermined temperature during a polishing operation, the temperature sensitive additive will change color, providing a visible change that can be detected by an operator of the polishing apparatus or by cameras as described above. Examples of suitable temperature sensitive additives can include certain thermochromic dyes, inks or polymers. In one embodiment, the temperature sensitive additive is a first color when finishing within an optimal working temperature range and is a second and/or third color when finishing outside of the optimal working range. For example, the temperature sensitive additive have an orange color when within the optimal working temperature range, have a clear or white color when below the optimal working temperature range, and have a black color when above the optimal working temperature range. As described above, one or more process parameters can be adjusted to maintain the optimal orange color of the temperature sensitive additive. Of course, these colors are exemplary and any suitable colors can be used.

Note that in some embodiments, workpiece 1300 has undergone a procedure to increase its emissivity, such as application of an emissive layer described above. In these embodiments, it may be possible to tune thermal imaging cameras 502*a*, 502*b* and/or 502*c* and display 1300 to monitor thermal changes in workpiece 1300 in addition to thermal changes in abrasive surface 1304 and/or the lubricant applied onto abrasive surface.

Measuring Current Draw of the Finishing Apparatus

According to some embodiments, the electric current drawn by the finishing apparatus (e.g., polishing wheel motor) is monitored as a means for determining thermal changes of the workpiece during a finishing operation. In many finishing operations the polishing wheel rotates at very high speeds, such as around 2000 revolutions per minute (RPM). Such high rotating speeds require use of a motor that draws significant electric current. Returning to FIG. 2B, during a finishing operation a resistance force is applied between workpiece 200 and polishing wheel 214, which is often referred to as wheel interference. When wheel interference is increased, the motor of polishing apparatus 210 draws more electric current in order to maintain a certain RPM of polishing wheel 214. Generally the higher the wheel interference, the higher the temperature of workpiece 200 due to frictional force between polishing wheel 214 and workpiece 200. Thus, changes in the electric current drawn by the motor of polishing system 210 can be directly associated with temperature changes of workpiece 200.

One way to accurately associate the electric current draw with temperature changes in workpiece 200 is by measuring the temperature of exterior surface 208 of workpiece during a calibration finishing operation. The temperature of exterior surface 208 can be measured using any of the direct or indirect thermal measurement techniques described above. For example, the interior surface 222 measurement techniques described above with reference to FIGS. 12A and 12B can be used to monitor changes. In particular, interior surface 222 temperature changes can be used to indirectly determine exterior surface 208 temperature changes during the calibration finishing operation. The current draw during the calibration finishing operation can be obtained using any suitable method. For example, many polishing apparatuses have software set up to monitor the real time current drawn by a polishing motor. In this way, temperature changes of exterior surface 208 can be associated directly with current draw changes of the motor during the calibration finishing operation. Once this association is established, current draw changes can be used to determine exterior surface 208 temperature changes in subsequent finishing operations.

It should be noted, however, that another factor that can affect changes in current draw relate to wear of polishing wheel 214. In particular, each time a finishing operation is performed, material from polishing wheel (i.e., at abrasive surface 216) is worn away. Thus, the size of the polishing wheel decreases with each finishing operation. Consequently, the force applied between polishing wheel 214 and workpiece 200 (wheel interference) decreases with each subsequent finishing operation. The force applied between polishing wheel 214 and workpiece 200 will continue to decrease until force is not high enough to sufficiently polish exterior surface 208, and at some point, polishing wheel 214 will no longer contact workpiece 200. One way to compensate for the decrease in size of polishing wheel 214 is by incrementally adjusting the position of workpiece 200 and/or polishing wheel 214 with each finishing operation. For example, the tool control path of fixturing device 212 can be adjusted to incrementally position workpiece 200 closer to polishing wheel 214 in accordance with the decrease in size of polishing wheel 214. Thus, these considerations should be considered when determining the relationship between changes in current draw and changes in exterior surface 208 temperature.

Finishing Operation Parameter Adjustments

As described above, the temperature of a workpiece should be maintained within an acceptable temperature range in order to avoid forming defects in the workpiece. The acceptable temperature range for the workpiece will depend on a number of factors, including the material, size and shape of the workpiece and process requirements (e.g., number and type of acceptable defects). Other factors, such as the type of lubricant used and the optimal temperature range of the lubricant, can also affect the temperature of the workpiece. Described above are a number of techniques used to directly or indirectly measure and monitor temperature changes of a workpiece during finishing operations to assure that the temperature of the workpiece is within the acceptable range. The monitored changes can be used adjust one or more parameters during the polishing operation to increase or decrease the temperature of the workpiece as desired, creating a feedback loop. Examples of some of these process parameters and how they can be adjusted will now be described. It should be noted that any suitable combination of adjusting parameters described below could be used in order to provide desirable results.

For illustrative purposes, reference will be made to FIGS. 2A and 2B. It should be noted, however, that any suitable workpiece having any suitable shape and size, and any suitable finishing apparatus can be used in accordance with described embodiments. In some embodiments, the temperature of workpiece 200 is maintained within the acceptable temperature range by adjusting the wheel interference. For example, a tool control path of fixturing device 212 can be adjusted in response to the monitored temperature changes of workpiece 200. If it is determined that the temperature of workpiece 200 is above the acceptable temperature range, the tool control path of fixturing device 212 can be adjusted to decrease the wheel interference with polishing wheel 214. If it is determined that the temperature of workpiece 200 is below the acceptable temperature range, the tool control path of fixturing device 212 can be adjusted to increase the wheel interference with polishing wheel 214.

Another way to maintain the temperature of workpiece 200 within the acceptable temperature range is by adjusting an amount of lubricant (e.g., wax) added between workpiece 200 and polishing wheel 214. The lubricant generally acts as a heat sink by reducing the friction between workpiece 200 and polishing wheel 214. Thus, more lubricant generally reduces the temperature of workpiece 200. Thus, if it is determined that the temperature of workpiece 200 is above the acceptable temperature range, the amount of lubricant can be increased. Similarly, if it is determined that the temperature of workpiece 200 is below the acceptable temperature range, the amount of lubricant can be decreased.

An additional way of maintaining the temperature of workpiece 200 within the acceptable temperature range is by adjusting the relative speed of polishing wheel 214 with respect to workpiece 200. In one embodiment, the relative speed is adjusted by controlling a rotation speed of polishing wheel 214. In another embodiment, the relative speed of polishing wheel 214 with respect to workpiece 200 is adjusted by controlling a rotation speed of workpiece 200. For example, end effector or gripper 218 can be configured to rotate about a central axis during the finishing operation. In one embodiment, both the rotation speeds of workpiece 200 and polishing wheel 214 are adjusted. Increasing speeds are generally associated with increasing temperatures of workpiece 200. Thus, if it is determined that the temperature of workpiece 200 is above the acceptable temperature range, the rotation speed of polishing wheel 214 and/or gripper 218 can be reduced. Similarly, if it is determined that the temperature of workpiece 200 is below the acceptable temperature range, the rotation speed of polishing wheel 214 and/or gripper 218 can be increased.

A further method for maintaining the temperature of workpiece 200 within an acceptable temperature range is by directly cooling or heating workpiece 200. For example, gripper 218 can be made of a thermally conductive material to conduct heat away from workpiece 200. That is, the heat generated at exterior surface 208 during the polishing operation can be conducted through wall 219 of workpiece 200 to interior surface 222, which is then transferred to gripper 218. In other embodiments, heat conduction from workpiece 200 to gripper 218 is minimized such that workpiece 200 retains the heat generated at exterior surface 208. This can be accomplished by, for example, by masking interior surface 222 of workpiece 200 with a thermally insulative film or mask, or by using a gripper 218 that is made of a thermally insulative material. In a particular example, the use of a polymer mask ended up increasing the temperature at exterior surface 208 from about 60 degrees C. to about 80 degrees C. during a finishing operation, which increased the amount of pitting defects on workpiece 200 by about 25%.

Another way to maintain the temperature of workpiece 200 within an acceptable temperature range is by adjusting ambient temperatures surrounding workpiece 200. In one embodiment, workpiece 200 and polishing wheel 214 are positioned within a temperature-controlled environment. For example, an air cooler can be positioned proximate to workpiece 200 and polishing wheel 214 to cool the air surrounding workpiece 200 and polishing wheel 214 during the finishing operation. Alternatively, a heater can be positioned to heat the air surrounding workpiece 200 and polishing wheel 214 during the finishing operation. In one embodiment, other factors such as humidity are also controlled. For example, a de-humidifier can be used to remove moisture within the air surrounding workpiece 200 and polishing wheel 214 during the finishing operation. This can be important if a build up of moisture on polishing wheel 214 and/or workpiece 200 can negatively affect adhesion of the lubricant to polishing wheel 214 and/or workpiece 200 during the finishing operation.

Figure 14:
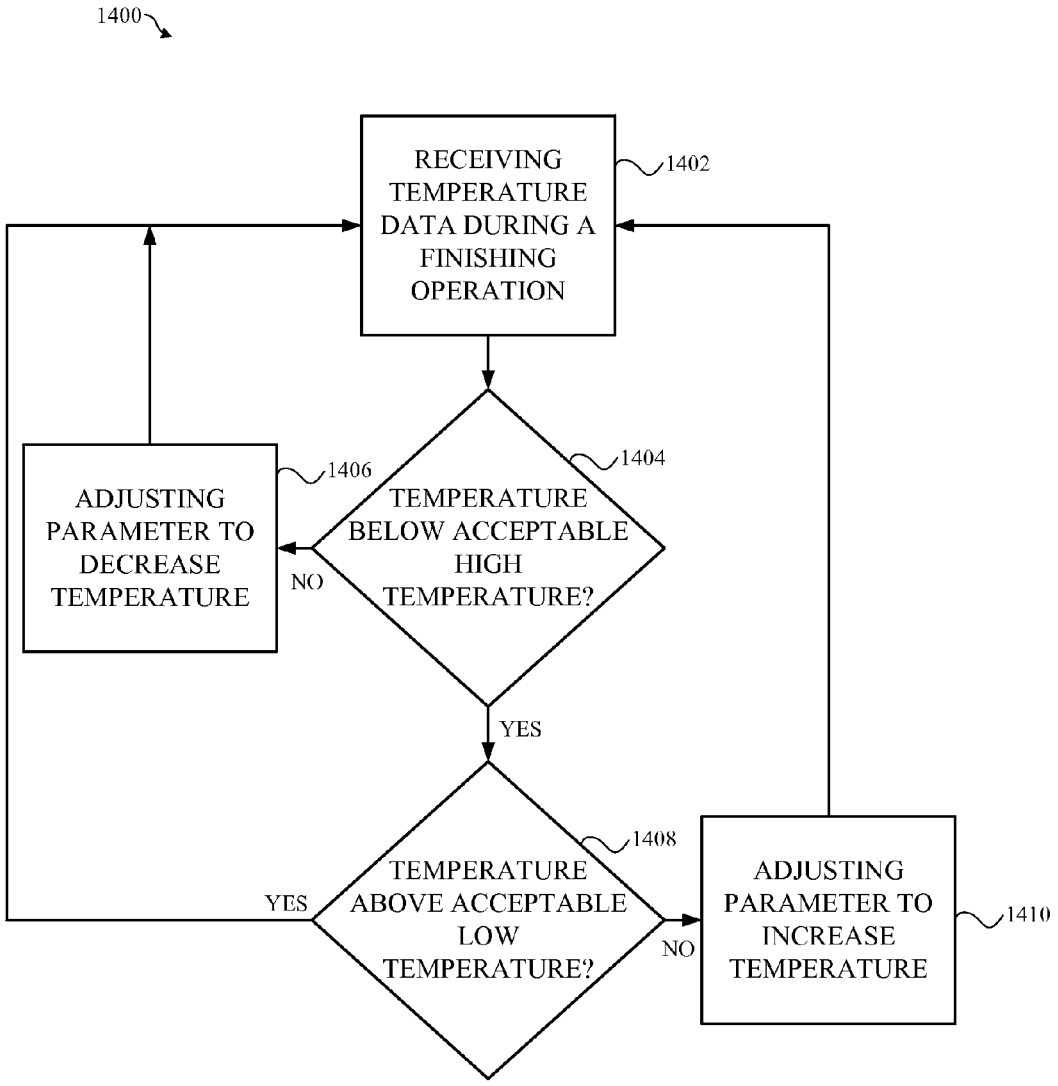
FIG. 14 shows a flowchart detailing a process that includes the use of an emissive layer for thermal characterization of a general machining process.

FIG. 14 is a flow chart detailing a general process 1400 for adjusting a finishing operation based on data related to workpiece temperature in accordance with some embodiments. Process 1400 represents a feedback loop for monitoring and adjusting a temperature during a finishing operation. At 1402, temperature data during a finishing operation is received. The temperature data can be related to the workpiece, or related to a polishing wheel and/or lubricant used during the finishing operation. Any of the techniques described herein can be used, including direct and indirect thermal measurements of the workpiece. In some embodiments, a combination of temperature measurement techniques is used. The method of receiving the temperature can vary depending on a number of factors including the size, shape and material of the workpiece, type of polishing wheel, type of lubricant, and the finishing apparatus used to perform the finishing operation. The temperature data can be stored and processed by a computer system, either as a separate unit or as part of the finishing apparatus. In some embodiments, the temperature data is visibly accessible to an operator of the finishing apparatus on a screen display. In some cases, temperatures of different portions of a workpiece are monitored.

At 1404, a determination is made as to whether the temperature is below an acceptable high temperature. In some cases, the acceptable high temperature can correspond to a temperature below a temperature that was previously found to create defects in the workpiece. For example, a workpiece, lubricant, or polishing temperature that is too high can cause the lubricant to lose moisture and clump up, causing pitting within the workpiece. If the temperature is determined not to be below the acceptable high temperature, at 1406 one or more process parameters are adjusted to decrease the temperature during the finishing operation. The one or more process parameters can include, for example, wheel interference, amount of lubricant, speed of the polishing wheel, speed of the workpiece, direct temperature control of workpiece, ambient temperature, etc.

If the temperature is determined to be below the acceptable high temperature, at 1408, a determination is made as to whether the temperature is above an acceptable low temperature. In some cases, the acceptable low temperature can correspond to a temperature above a temperature that was previously found to create defects in the workpiece. For example, a workpiece, lubricant, or polishing temperature that is too low can increase viscosity of the lubricant, causing scratching or hazing of the workpiece. If the temperature is determined not to be above the acceptable low temperature, at 1410 one or more process parameters are adjusted to increase the temperature during the finishing operation. The one or more process parameters can include, for example, wheel interference, amount of lubricant, speed of the polishing wheel, speed of the workpiece, direct temperature control of workpiece, ambient temperature, etc. If the temperature is determined to be above the acceptable low temperature, no process parameter adjustments are made and the finishing operation continues until the finishing operation is complete.

Multiple Variable Feedback Systems

Figure 15:
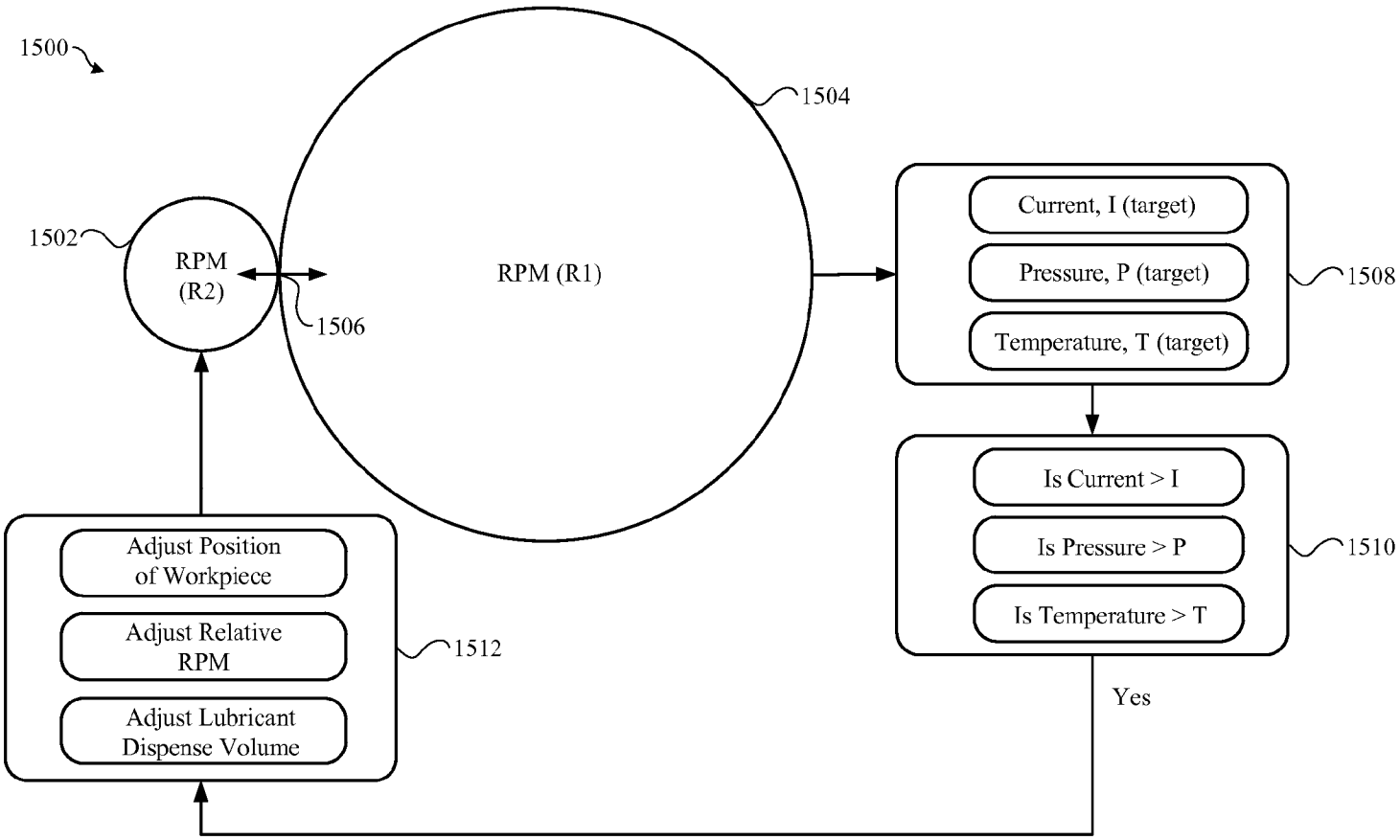
FIG. 15 shows a diagram indicating a multiple variable feedback system for monitoring and adjusting a finishing operation.

As described above, multiple measurements can be monitored and multiple process parameters can be adjusted during a single finishing operation. FIG. 15 shows diagram 1500 indicating an example multiple variable feedback system in accordance with some embodiments. Diagram 1500 shows workpiece 1502 in contact with finishing wheel 1504 (e.g., buffing or polishing wheel) during a finishing operation. Finishing wheel 1504 can rotate at a first RPM (R1) and workpiece 1502 can rotate at a second RPM (R2). In some embodiments, only finishing wheel 1504 rotates while workpiece 1502 does not rotate (i.e., R2=0). Alternatively, workpiece 1502 can rotate while finishing wheel 1504 does not rotate (i.e., R1=0). In other embodiments, both workpiece 1502 and finishing wheel 1504 rotate independently. Arrow 1506 represents a relative movement of workpiece 1502 with respect to finishing wheel 1504, which directly affects the wheel interference and pressure placed upon workpiece 1502 and/or finishing wheel 1504 during the finishing operation. During the finishing operation finishing wheel 1504 contacts a surface area of workpiece, sometimes referred to as the contact patch area.

Box 1508 represents different target process parameters for the finishing process, including a target current I, a target pressure P, and a target temperature T. The target current I corresponds to a predetermined electrical current value of a motor that rotates finishing wheel 1504 or a motor that rotates workpiece 1502 that produces optimal results for workpiece 1502. As described above, the electric current of a motor can indicate an amount of work performed by the motor, which can be correlated with a wheel interference or interface friction between workpiece 1502 and finishing wheel 1504. Thus, the target current I indicates an amount of wheel interference or interface friction that produces ideal results, such as the least amount of defects and good reflectance (shine) in workpiece 1502. In some embodiments, target current I corresponds to a range of target current values. In some embodiments, two target currents (I1 and I2) are measured for each motor rotating workpiece 1502 and finishing wheel 1504.

The target pressure P corresponds to a predetermined target pressure applied to workpiece 1502 and/or finishing wheel 1504 that produces optimal results for workpiece 1502. A pressure applied to workpiece 1502 can be measured, for example, using one or more pressure sensors positioned on a support piece supporting workpiece 1502 (e.g., end effector or gripper 218). The pressure applied to workpiece 1502 can be used to calculate the contact patch area and amount of material removed from workpiece 1502. A pressure applied to finishing wheel 1504 can be measured, for example, using one or more pressure sensors positioned on or within finishing wheel 1504. The pressure sensor can include any suitable type of pressure sensor or combination of pressure sensors, including capacitive and piezoelectric types of sensors. The target temperature T corresponds to a predetermined target temperature of workpiece 1502, finishing wheel 1504 and/or a lubricant used during the finishing operation. As described above, the temperature of a workpiece, finishing wheel (e.g., abrasive surface) and/or lubricant can be measured, for example, using one or more of the techniques described above. The target current I, target pressure P, and target temperature T can be stored on a computer system, such computer system 500 described above.

Box 1510 represents a decision based on the measured current, measured pressure and measured temperature during the finishing operation. In particular, a determination is made as to whether the measured current is greater than target current I, the measured pressure is greater than the target pressure P, and/or the measured temperature is greater than target temperature T. These determinations can be performed by a computer system, such as computer system 500 described above. If any of these are true, than at box 1512 one or more process parameters: position of workpiece 1502 relative to finishing wheel 1504 (represented by arrow 1506), the relative RPM (R1 and/or R2) and a volume of lubricant dispensed is adjusted. In general, increasing the volume of lubricant dispensed decreases the interface friction as well as the amount of material removed from workpiece 1502. Adjusting one or more of these process parameters can be used to decrease or increase the current, pressure and temperature to target current I, target pressure P and/or target temperature T, respectively. These adjustments can be controlled by a computer system, such as computer system 500 described above. For example, moving workpiece 1502 farther away from finishing wheel 1504, reducing the relative RPM and/or increasing the amount of lubricant can bring the measured current to target current I, the measured pressure to target pressure P, and the measured temperature is greater than to target temperate T. In this way, diagram 1500 represents a multivariable feedback loop.

Figure 16:
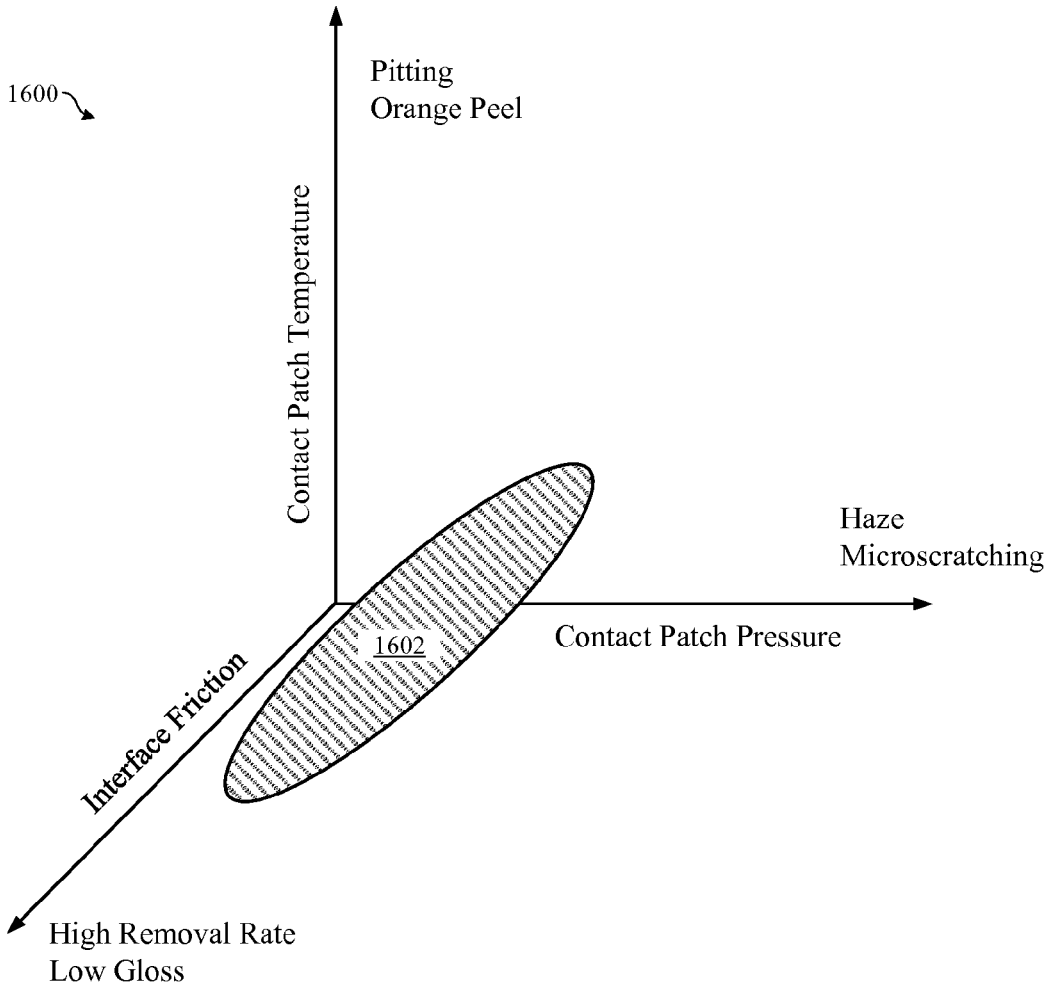
FIG. 16 shows a three-dimensional graph representing a relationship of an interface friction, a contact patch temperature and a contact patch pressure of a finishing operation.

FIG. 16 shows three-dimensional graph 1600 representing a relationship of interface friction, contact patch temperature and contact patch pressure of a finishing operation. The interface friction corresponds to an amount of friction between workpiece 1502 and finishing wheel 1504 at the contact patch area of workpiece 1502. Interface friction that is too high can result in high removal rate of material from workpiece 1502 and low gloss of the finished surface of workpiece 1502. The contact patch pressure corresponds to a pressure at the contact patch area of workpiece 1502. Contact patch pressure that is too high can result in a hazed appearance and microscratching of workpiece 1502. The contact patch temperature corresponds to a temperature at the contact patch area of workpiece 1502. Contact patch temperature that is too high can result in pitting or an "orange peel" effect of workpiece 1502. An orange peel effect generally corresponds to an undesirable roughness of a workpiece surface. Optimal zone 1602 corresponds a combination of optimal interface friction, contact patch pressure and contact patch temperature that gives an optimally mirror finish to workpiece 1502.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data, which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for finishing a surface of a workpiece, the surface being modified with an emissive layer that comprises a metal oxide layer disposed on the surface of the workpiece, the method comprising:

performing a finishing operation by contacting and moving an abrasive surface relative to the surface of the workpiece, wherein a thermal characteristic of the workpiece changes during the finishing operation;

monitoring the changes of the thermal characteristic by monitoring a thermal radiation of the surface of the workpiece; and adjusting a parameter of the finishing operation based on the monitored changes of the thermal characteristic to maintain the thermal characteristic within a predetermined range during the finishing operation.

2. The method of claim 1, wherein monitoring the changes of the thermal characteristic further comprises monitoring a temperature of a second surface of the workpiece, the second surface being different than the surface of the workpiece on which the finishing operation is being performed.

3. The method of claim 1, wherein monitoring the changes of the thermal characteristic further comprises monitoring thermal images of one or more of the surface of the workpiece, the abrasive surface and a lubricant used during the finishing operation.

4. The method of claim 3, wherein the thermal images are formed by:

directing an infrared light at one or more of the surface of the workpiece, the abrasive surface and the lubricant, measuring reflected infrared light reflected off one or more of the surface of the workpiece, the abrasive surface and the lubricant, and collecting data related to the reflected infrared light.

5. The method of claim 1, wherein monitoring the changes of the thermal characteristic further comprises monitoring changes in a color of a lubricant used in the finishing operation, the lubricant having an additive that changes color when a predetermined temperature is reached.

6. The method of claim 1, wherein adjusting the parameter of the finishing operation comprises adjusting one or more of the following during the finishing operation:

a force of the abrasive surface applied to the surface of the workpiece, an amount of lubricant applied between the abrasive surface and the surface of the workpiece, a speed of the abrasive surface moving relative to the surface of the workpiece, a temperature of the workpiece, and an ambient temperature of air surrounding the workpiece.

7. A method of finishing a workpiece, the method comprising:

forming an emissive layer on an outside surface of the workpiece to increase an emissivity of the workpiece, wherein the emissive layer is a dyed oxide layer;

performing a surface finishing operation on the workpiece, wherein a temperature of the emissive layer changes during the surface finishing operation; and monitoring an amount of thermal radiation emitted by the emissive layer during the surface finishing operation with a thermal imaging system, wherein the thermal imaging system is configured to distinguish temperature variations of the emissive layer.

8. The method of claim 7, wherein the emissive layer has a durability such that the surface finishing operation does not substantially degrade the emissive layer.

9. The method of claim 7, wherein a thermal conductivity of the emissive layer is substantially similar to a thermal conductivity of the workpiece.

10. The method of claim 7, wherein the workpiece is a metal workpiece.

11. The method of claim 7, further comprising:

detecting a thermal characteristic based on thermal radiation emitted during the surface finishing operation; and modifying the surface finishing operation in response to detecting the thermal characteristic.

12. The method of claim 11, wherein the thermal characteristic exceeds a threshold value based on historical results from previous surface finishing operations.

13. The method of claim 7, wherein the workpiece is a plastic workpiece and the surface finishing operation is configured to remove an excess amount of plastic from the workpiece.

14. The method of claim 7, further comprising:

applying a second emissive layer on a portion of a fixturing device configured to position the workpiece during the surface finishing operation; and monitoring an amount of thermal radiation emitted by the second emissive layer with the thermal imaging system.

* * * * *